US006962487B2

(12) United States Patent
Caldwell

(10) Patent No.: US 6,962,487 B2
(45) Date of Patent: Nov. 8, 2005

(54) FLUID DRIVEN PUMP WITH IMPROVED EXHAUST PORT ARRANGEMENT

(75) Inventor: Denise M. Caldwell, North Apollo, PA (US)

(73) Assignee: Versa-Matic Tool, Inc., Export, PA (US)

( * ) Notice: Subject to any disclaimer, the term of this patent is extended or adjusted under 35 U.S.C. 154(b) by 203 days.

(21) Appl. No.: 10/636,727

(22) Filed: Aug. 7, 2003

(65) Prior Publication Data

US 2005/0031467 A1 Feb. 10, 2005

(51) Int. Cl.[7] ..... F04B 43/06
(52) U.S. Cl. ..... 417/395; 417/393
(58) Field of Search ..... 417/393, 394, 417/395

(56) References Cited

U.S. PATENT DOCUMENTS

| | | | | |
|---|---|---|---|---|
| 2,944,528 A | | 7/1960 | Phinney | |
| 3,071,118 A | | 1/1963 | Wilden | |
| 3,176,719 A | | 4/1965 | Nord et al. | |
| 3,304,126 A | | 2/1967 | Rupp et al. | |
| 3,454,214 A | | 7/1969 | Milleron | |
| 3,635,125 A | | 1/1972 | Rosen et al. | |
| 3,791,768 A | | 2/1974 | Wanner | |
| 3,838,946 A | | 10/1974 | Schall | |
| 3,850,082 A | | 11/1974 | Nussbaumer | |
| 4,386,888 A | * | 6/1983 | Verley | 417/393 |
| 4,406,596 A | | 9/1983 | Budde | |
| 4,496,294 A | | 1/1985 | Frikker | |
| 4,524,803 A | | 6/1985 | Stoll et al. | |
| 4,566,867 A | | 1/1986 | Bazan et al. | |
| 4,817,503 A | | 4/1989 | Yamada | |
| 4,854,832 A | | 8/1989 | Gardner et al. | |
| 4,921,408 A | | 5/1990 | Kvinge et al. | |
| 5,232,352 A | | 8/1993 | Robinson et al. | |
| 5,277,555 A | | 1/1994 | Robinson | |
| 5,326,234 A | | 7/1994 | Versaw et al. | |
| 5,527,160 A | | 6/1996 | Kozumplik, Jr. et al. | |
| 5,584,666 A | | 12/1996 | Kozumplik, Jr. et al. | |
| 6,619,932 B2 | * | 9/2003 | Murata | 417/395 |
| 6,644,941 B1 | * | 11/2003 | Able et al. | 417/393 |

* cited by examiner

*Primary Examiner*—Charles G. Freay
(74) *Attorney, Agent, or Firm*—Kirkpatrick & Lockhart Nicholson Graham LLP

(57) ABSTRACT

A fluid driven pump. One embodiment of the fluid driven pump may include first and second diaphragms supported within a housing assembly such that first and second fluidtight expansion chambers are defined within the housing. The pump may have a first exhaust valve movably supported in a first exhaust valve cavity in fluid communication with the first expansion chamber and an exhaust port in the housing assembly. In addition, the pump may have a second exhaust valve movably supported in a second exhaust valve cavity in fluid communication with the second expansion chamber and the exhaust port. A flow control system may be supported by the housing assembly and be couplable to a source of pressurized control fluid. The flow control system may control flow of pressurized fluid into and out of the first and second expansion chambers such that pressurized fluid entering the first expansion chamber flows through a first passage in the housing assembly independent from a first exhaust passage which connects the first exhaust valve cavity to the first expansion chamber and such that pressurized fluid entering the second expansion chamber flows through a second passage in the housing assembly independent from a second exhaust passage connecting the second exhaust valve cavity to the second expansion chamber.

25 Claims, 17 Drawing Sheets

FLUID DRIVEN PUMP WITH IMPROVED EXHAUST PORT ARRANGEMENT

BACKGROUND

1. Field of the Invention

The present invention relates to devices useful for pumping fluids and semisolids. More particularly, the present invention relates to devices such as double diaphragm pumps which are driven by a fluid.

2. Description of the Invention Background

Various devices have been developed which are useful for pumping fluids or semisolids and which are driven by some type of a fluid such as air. Many of such devices which use air, compress the air during a portion of the pumping cycle and then exhaust the compressed air to atmospheric pressure. If there is water vapor in the air, i.e., humidity, and it is not removed from the compressed air before it enters the pump, the cooling effect of polytropic, adiabatic expansion of the compressed air as it is exhausted can cause the water to freeze. As an example, if the relative humidity of the air is 40 percent and a volume of that air is compressed to one half of its original volume, the relative humidity of the air becomes 80 percent because the volume of the water does not significantly change. The temperature drop caused by adiabatic expansion of the compressed air from a pressure of 4.5 bar (approximately 65 psi) to atmospheric pressure, at a room temperature of 68 degrees Fahrenheit, is about 120 degrees Fahrenheit. Thus, when the air undergoes rapid adiabatic expansion, i.e., expansion without the addition of heat, the temperature of the air drops quickly and the moisture in the air freezes. When the moisture freezes it tends to build up in and block an exhaust passage of an air driven pump, and it eventually can completely shut off the exhaust passage, preventing operation of the pump. The temperature reduction can be so great that not only will the water vapor in the exhaust air freeze, but also the housing of the pump can become so cold that water vapor in the atmosphere will condense and freeze on the exterior of the pump.

Various air driven pumps have accordingly been designed which include some provision for reducing the freezing of water vapor entrained in the air which drives the pump, or for reducing blockage of an exhaust passage of the pump due to freezing of the water vapor. These pumps generally utilize either some type of air mixing or some type of moving element to attempt to reduce ice formation therein.

SUMMARY

One embodiment of the present invention may comprise a fluid driven pump that includes a housing assembly and a first diaphragm that is supported in the housing assembly such that a first pumping chamber and a first fluidtight expansion chamber are formed within the housing assembly. This embodiment of the present invention may also include a second diaphragm that is supported in the housing assembly opposite to the first diaphragm and which is coupled to the first diaphragm. The second diaphragm serves to define a second pumping chamber and a second fluidtight expansion chamber within the housing assembly. In addition, this embodiment may include a first exhaust valve movably supported in a first exhaust valve cavity which is in fluid communication with the first expansion chamber and an exhaust port in the housing assembly. A second exhaust valve may be movably supported in a second exhaust valve cavity which is in fluid communication with the second expansion chamber and the exhaust port. A flow control system may be supported by the housing assembly and be couplable to a source of pressurized control fluid. The flow control system may control the flow of pressurized fluid into and out of the first and second expansion chambers such that pressurized fluid entering the first expansion chamber flows through a first passage in the housing assembly independent from a first exhaust passage connecting the exhaust valve cavity to the first expansion chamber and such that pressurized fluid entering the second expansion chamber flows through a second passage in the housing assembly independent from a second exhaust passage connecting the second exhaust valve cavity to the second expansion chamber.

Another embodiment of the present invention may comprise a fluid driven pump which includes a housing assembly that supports a first diaphragm to define a first pumping chamber and a first fluidtight expansion chamber within the housing assembly. A second diaphragm may be supported in the housing assembly opposite to the first diaphragm and be coupled to the first diaphragm. The second diaphragm may define a second pumping chamber and a second fluidtight expansion chamber within the housing assembly. A control housing may be supported by the housing assembly and be attachable to a source of pressurized control fluid. The control housing may movably support a diverter block therein which may be movable between first and second positions. A first exhaust valve may be movably supported in a first exhaust valve flow cavity in the housing assembly which is in fluid communication with the first expansion chamber and an exhaust port in the housing assembly. A second exhaust valve may be movably supported in a second exhaust valve cavity which is in fluid communication with the second expansion chamber and the exhaust port. A first expansion chamber flow passage may also be provided in the housing assembly. The first expansion chamber flow passage may extend between the control housing and the first expansion chamber such that when the diverter block is in the first position, pressurized fluid entering the control housing is permitted to flow into the first expansion chamber. A second expansion chamber flow passage may also be provided in the housing assembly. The second expansion chamber flow passage may extend between the control valve housing and the second expansion chamber such that when the diverter block is in the second position, pressurized fluid entering the control housing is permitted to flow into the second expansion chamber. This embodiment may further include a first exhaust valve flow passage in the housing assembly which may extend between the control housing and the first exhaust valve cavity such that when the diverter block is in the first position, pressurized fluid entering the control housing biases the first exhaust valve into a closed position. When the first exhaust valve is in the closed position, the first expansion chamber may be pressurized. When the diverter block is in the second position, the diverter block causes the first exhaust valve flow passage to communicate with an exhaust port in the housing assembly to enable the first exhaust valve to move to an exhaust position wherein the first expansion chamber can communicate with the exhaust port. This embodiment of the present invention may be provided with a second exhaust valve flow passage in the housing assembly that extends between the control housing and the second exhaust valve cavity such that when the diverter block is in the second position, pressurized fluid entering the control housing biases the second exhaust valve to a closed position wherein the second expansion chamber can be pressurized. When the diverter is in the first position, the diverter causes the second exhaust valve flow passage to communicate with the exhaust port in the housing assembly to enable the second exhaust valve to move to a second exhaust position. When the second exhaust valve is in the second position, the expansion chamber is in fluid communication with the exhaust port. A pilot valve may be supported in the housing assembly in fluid communication with the control housing and be oriented within the housing assembly such that the expansion and contraction of the first and second expansion chambers causes the pilot valve to control flow of pressurized fluid into and out of the control housing to control movement of the diverter block therein.

BRIEF DESCRIPTION OF THE DRAWINGS

In the accompanying Figures, there are shown present embodiments of the invention wherein like reference numerals are employed to designate like parts and wherein.

DETAILED DESCRIPTION

Figure 1:
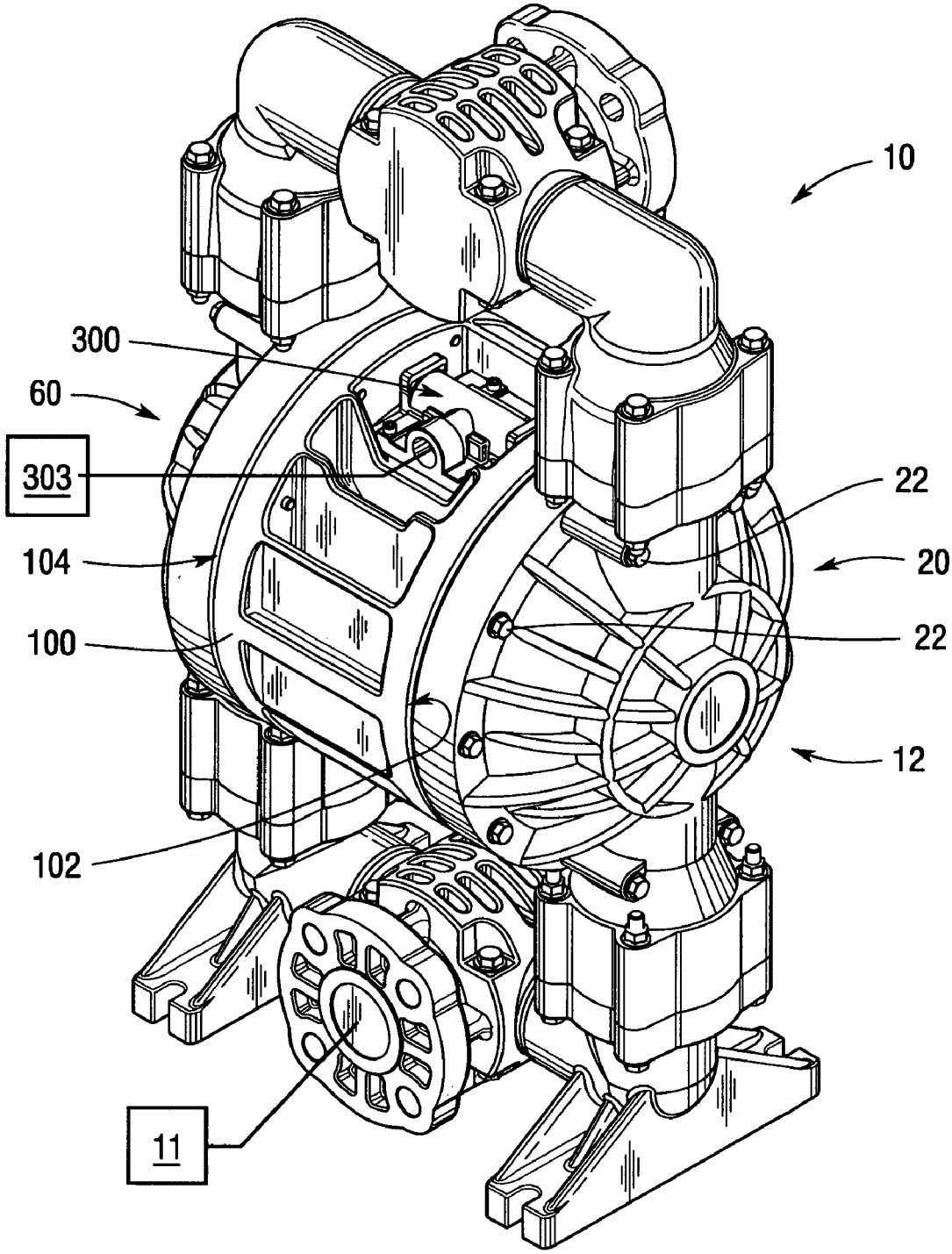
FIG. 1 is a perspective view of a fluid driven pump which may employ features of the present invention.
Figure 3:
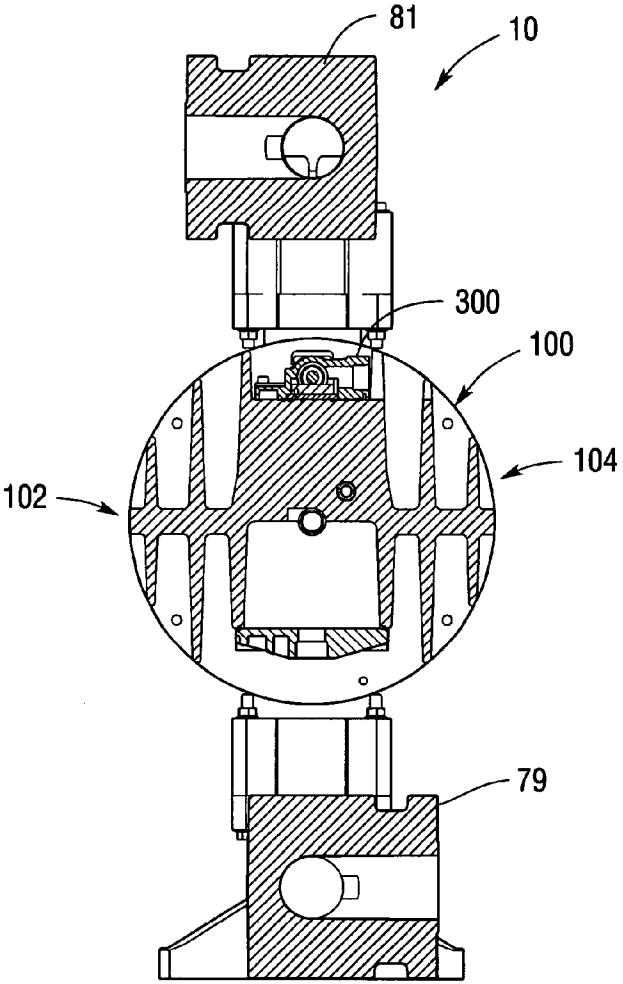
FIG. 3 is a cross-sectional view of the pump of FIGS. 1 and 2, taken along line III—III in FIG. 2.
Figure 2:
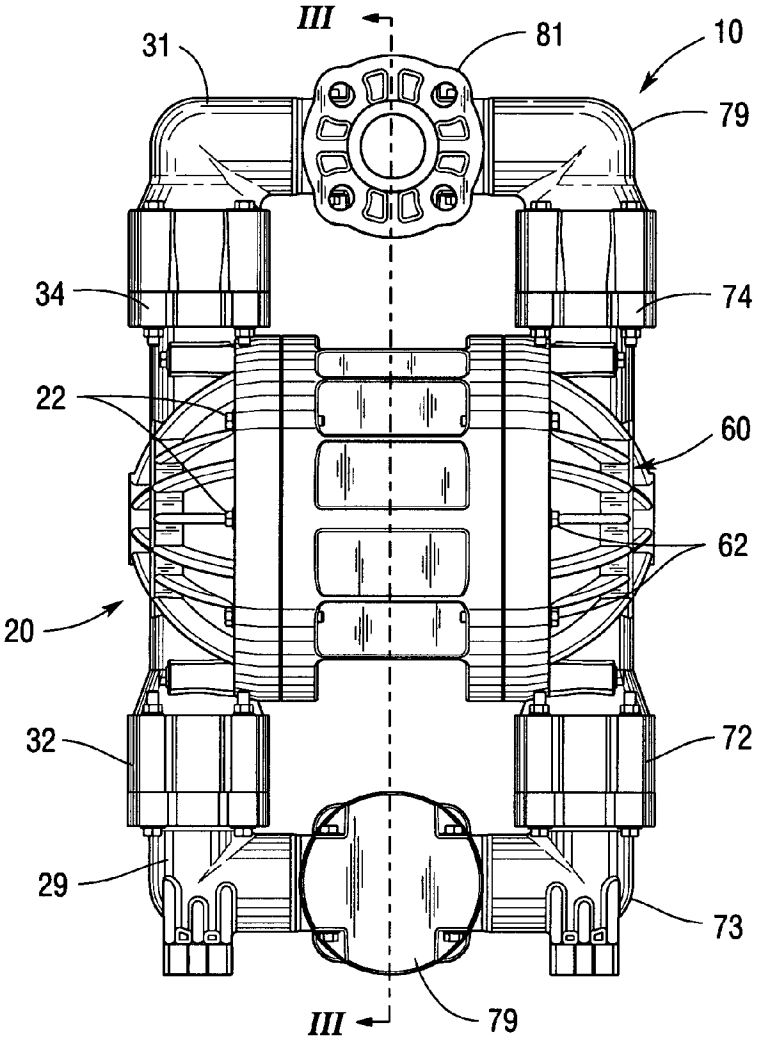
FIG. 2 is a front elevational view of the pump of FIG. 1.
Figure 4:
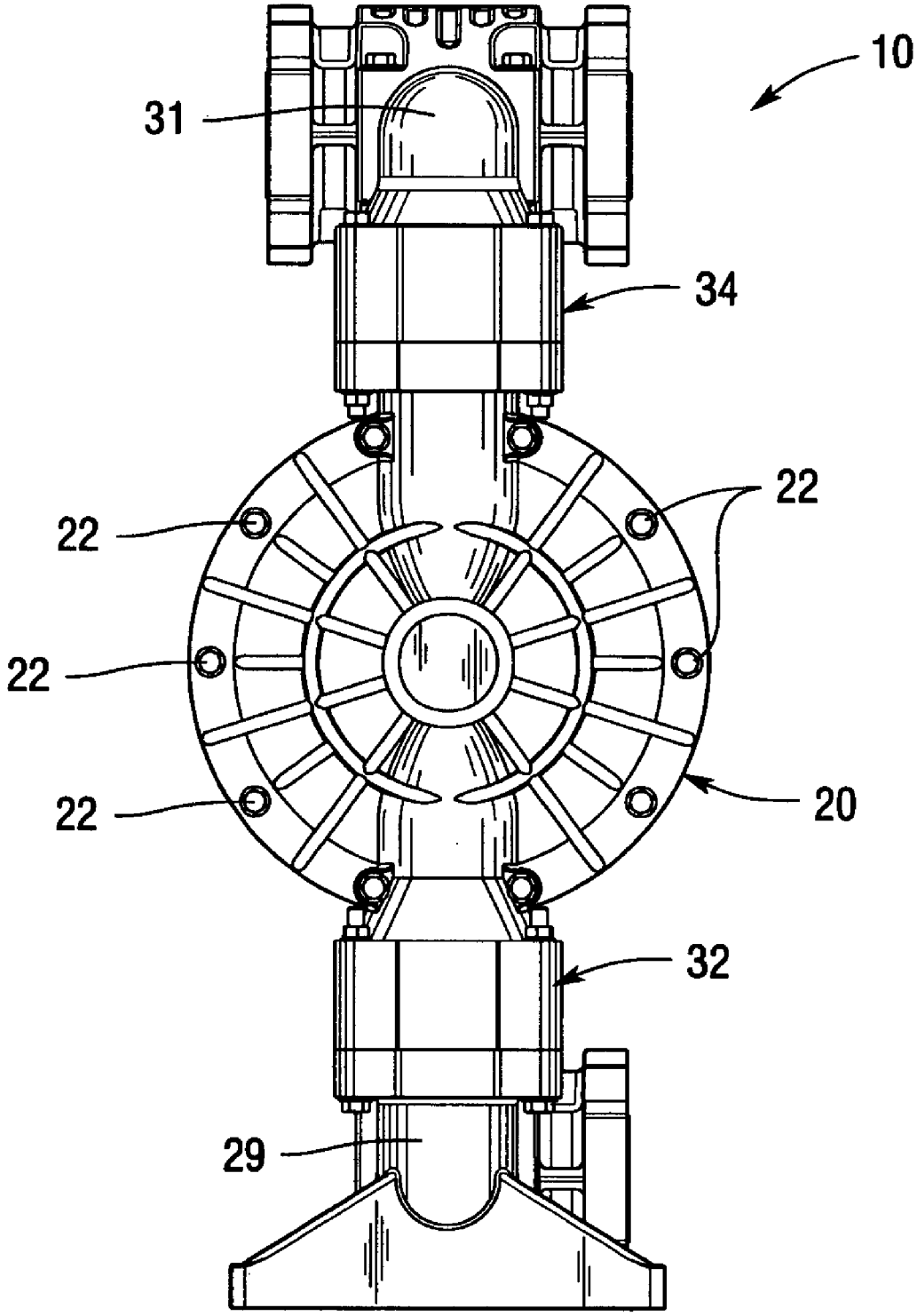
FIG. 4 is an elevational view of the left end of the pump of FIGS. 1–3.

Referring now to the drawings for the purposes of illustrating the present embodiments of the invention only and not for the purposes of limiting the same, the Figures show an embodiment of a fluid driven pump 10 of the present invention that may be used to pump fluids and/or semisolid materials from a source of such materials graphically designated as 11 in FIG. 1. Various aspects of other fluid pumps such as the pump disclosed in U.S. Pat. No. 5,326,234 to Versaw et al., the disclosure of which is herein incorporated by reference, could also be employed. More particularly and with reference to FIGS. 1–6, an embodiment of the fluid driven pump 10 may include a housing assembly 12 that includes a center housing section 100, a first housing section 20 and a second housing section 60. Center housing section 100 and first and second housing sections 20 and 60 may be fabricated from a polymeric material such as, for example, polypropylene, Kynar®, etc. Sections 100, 20 and 60 may also be fabricated from other material that is compatible with the types of materials to be pumped and/or the environment in which the pump 10 is to be used. For example, sections 100, 20 and/or 60 may be fabricated from metal material such as, for example, carbon steel, stainless steel, aluminum, titanium, cast iron, Hastelloy®, etc. In addition, housing 12 could be fabricated as a single piece if desired.

Figure 6:
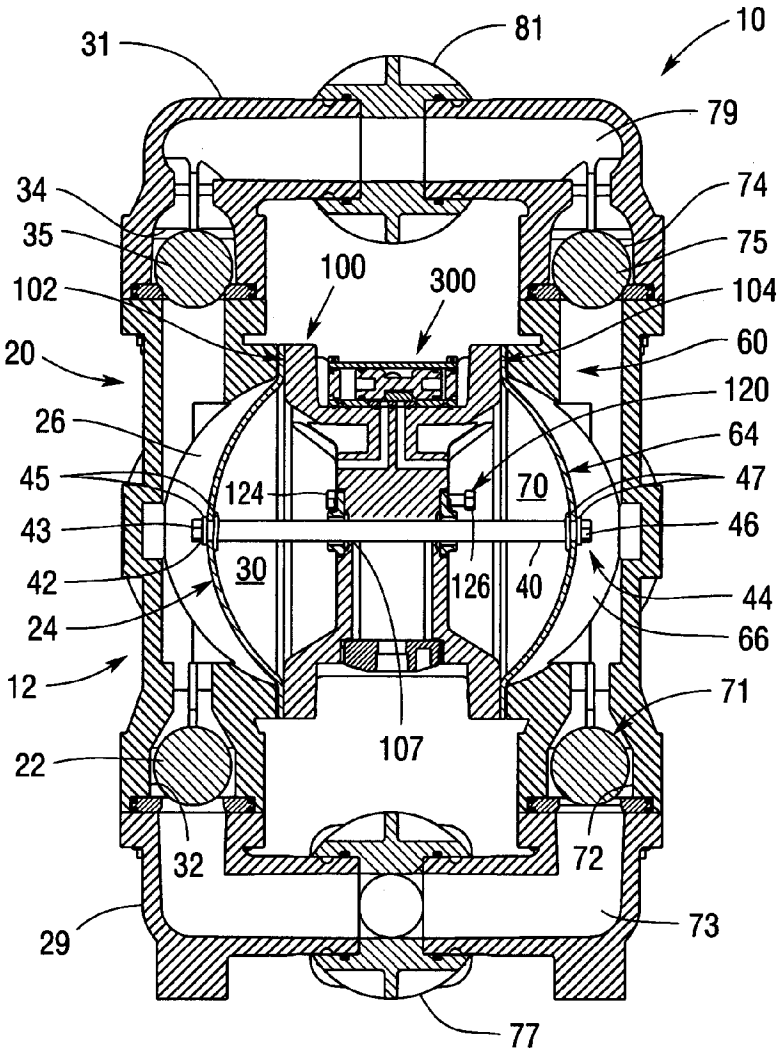
FIG. 6 is a cross-sectional view of the pump of FIGS. 1–5 taken along line VI—VI in FIG. 5.
Figure 5:
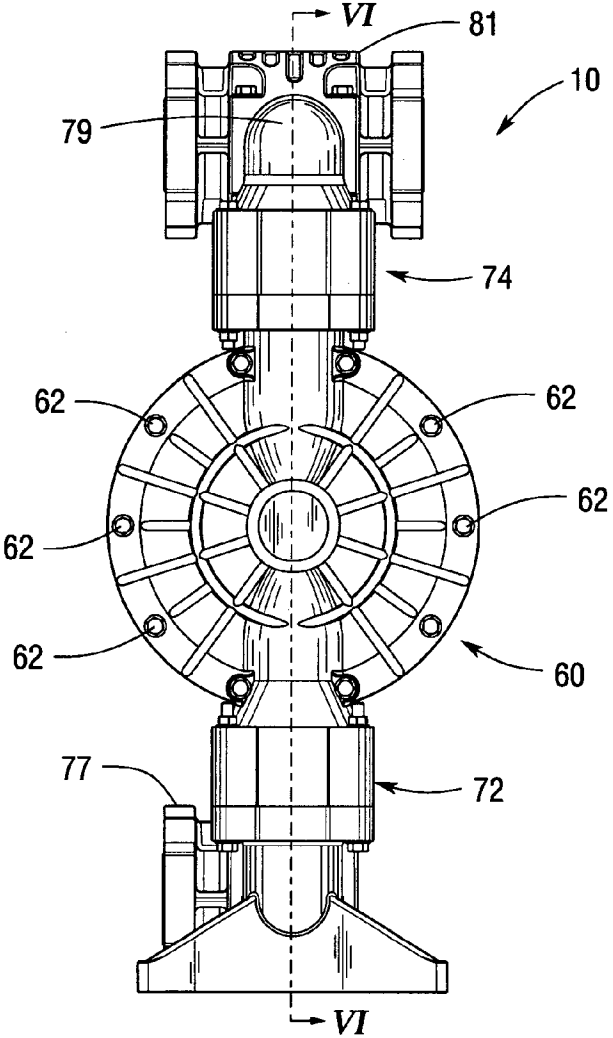
FIG. 5 is an elevational view of the right end of the pump of FIGS. 1–4.
Figure 8:
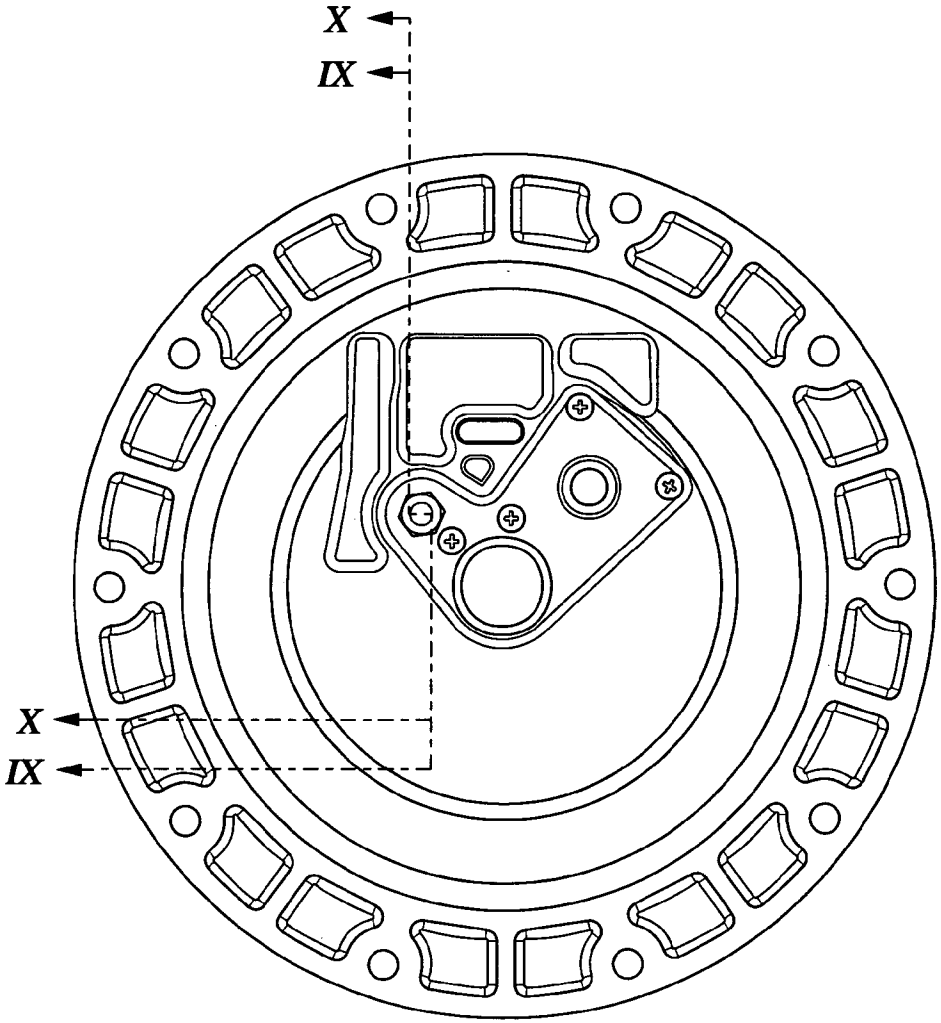
FIG. 8 is a side elevational view of a center housing section of one embodiment of the present invention.
Figure 11:
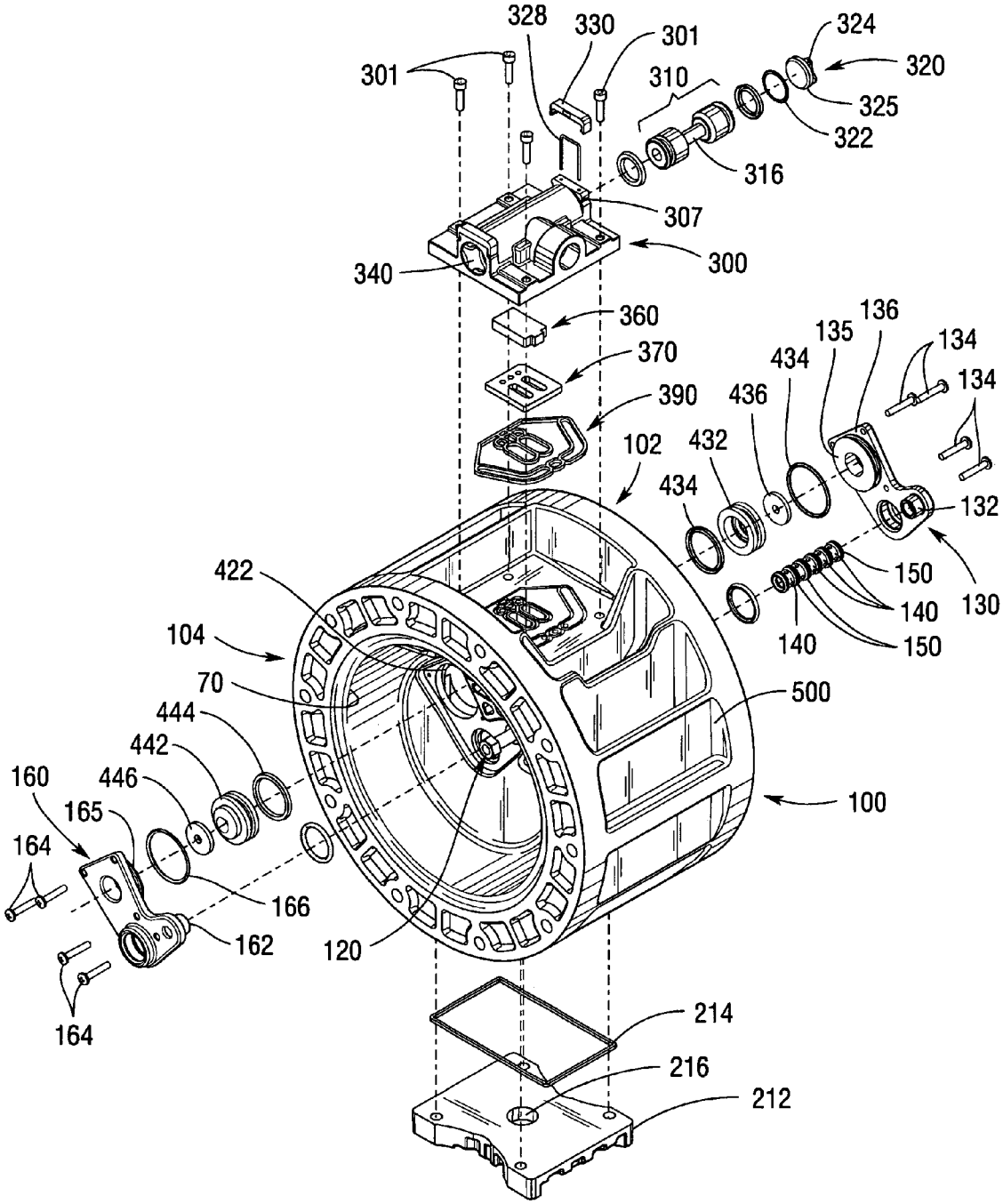
FIG. 11 is an exploded assembly view of a center housing section of one embodiment of the present invention.

As can be seen in FIGS. 1, 6 and 11, the center housing section 100 may be generally cylindrical in shape and have a first end 102 and a second end 104. The first housing section 20 may be removably attached to the first end 102 of the center housing section 100 by removable fasteners such as, for example, cap screws 22 that are threadably received in threaded holes (not shown) provided in the first end 102 of the center housing section 100. See FIGS. 1–3. A first diaphragm 24 fabricated from Teflon®, thermoplastics, rubber, etc. or other suitable material is positioned between the first housing section 20 and the first end 102 of the center housing section 100 and serves to achieve an airtight seal therebetween while also forming a first airtight pumping chamber 26 with the first housing section 20 and a first airtight expansion chamber 30 with the first end 102 of the center housing section 100. See FIG. 6.

Referring now to the drawings for the purposes of illustrating the present embodiments of the invention only and not for the purposes of limiting the same, the FIGS. show an embodiment of a fluid driven pump 10 of the present invention that may be used to pump fluids and/or semisolid materials from a source of such materials graphically designated as 11 in FIG. 1. Various aspects of other fluid pumps such as the pump disclosed in U.S. Pat. No. 5,326,234 to Versaw et al., the disclosure of which is herein incorporated by reference, could also be employed. More particularly and with reference to FIGS. 1–6, an embodiment of the fluid driven pump 10 may include a housing assembly 12 that includes a center housing section 100, a first housing section 20 and a second housing section 60. Center housing section 100 and first and second housing sections 20 and 60 may be fabricated from a polymeric material such as, for example, polypropylene, Kynar®, etc. Sections 100, 20 and 60 may also be fabricated from other material that is compatible with the types of materials to be pumped and/or the environment in which the pump 10 is to be used. For example, sections 100, 20 and/or 60 may be fabricated from metal material such as, for example, carbon steel, stainless steel, aluminum, titanium, cast iron, Hastelloy®, etc. In addition, housing assembly 12 could be fabricated as a single piece if desired.

The first housing section 20 may have a first inlet port 32 and a first outlet port 34 therein which communicate with the first pumping chamber 26. Supported within the first inlet port 32 is a conventional "one-way" check valve 22 that permits the material to be pumped to enter into the first pumping chamber 26 through the first inlet port 32 while preventing such material from passing back through first inlet port 32. See FIG. 6. Likewise, another conventional one-way check valve 35 may be supported within the first outlet port 34 to permit material to exit the first pumping chamber 26 through first outlet port 34 while preventing material from passing back into the first pumping chamber 26 through the first outlet port 34. A supply conduit 29 for supplying the material to be pumped to the first pumping chamber 26 may be attached to the first inlet port 32. Likewise, a discharge conduit 31 may be attached to the first outlet port 34.

The second housing section 60 may have a second inlet port 72 and a second outlet port 74 therein which communicate with the second pumping chamber 66. Supported within the second inlet port 72 is a conventional "one-way" check valve 71 that permits material to enter into the second pumping chamber 66 through the second inlet port 72 while preventing such material from passing back through second inlet port 72. Likewise, another conventional one-way check valve 75 may be supported within the second outlet port 74 to permit material to exit the second pumping chamber 66 through second outlet port 74 while preventing material from passing back into the second pumping chamber 66 through the second outlet port 74. A supply conduit 73 for supplying the material to be pumped to the second pumping chamber 66 may also be attached to the second inlet port 72 and a central coupler 77 which may also be attached to supply line 29. Likewise, a discharge conduit 79 may be attached to the second outlet port 74 and a coupler 81 which is also coupled to discharge conduit 31.

Figure 7:
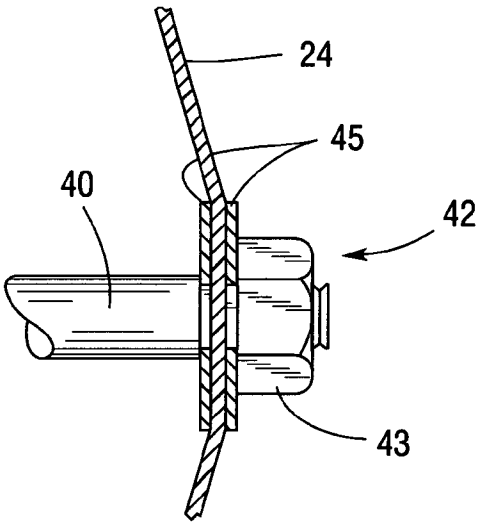
FIG. 7 is a partial enlarged view showing the attachment of the shaft to the first diaphragm of the pump of FIGS. 1–6.

In this embodiment, the first and second diaphragms 24, 64 may be interconnected by a diaphragm shaft 40 that has a first threaded end 42 and a second threaded end 44. In one embodiment, the first threaded end 42 is attached to the first diaphragm 24 by a first nut 43 and the second threaded end 44 is attached to the second diaphragm by a second nut 46. However, other methods of fastening the diaphragm shaft 40 to the first and second diaphragms 24, 64 could be employed. Also in this embodiment, a portion of the first diaphragm 24 is trapped between a pair of first washers 45 journaled on the diaphragm shaft 40 and the second diaphragm 64 is trapped between a pair of second washers 47 journaled on the diaphragm shaft 40. See FIG. 7. The diaphragm shaft 40 extends through a shaft passage 107 in the center housing section 100. See FIG. 6. A fluidtight sliding seal may be established between the diaphragm shaft 40 and center housing section 100 by an O-ring 109 on both sides of the center housing which are held in place by corresponding shaft retainers 130 and 160. Accordingly, as one of the chambers 30, 70 expands due to outward movement of its respective diaphragm, the other of the chambers 30, 70 contracts due to inward movement of its respective diaphragm 24, 64.

Figure 9:
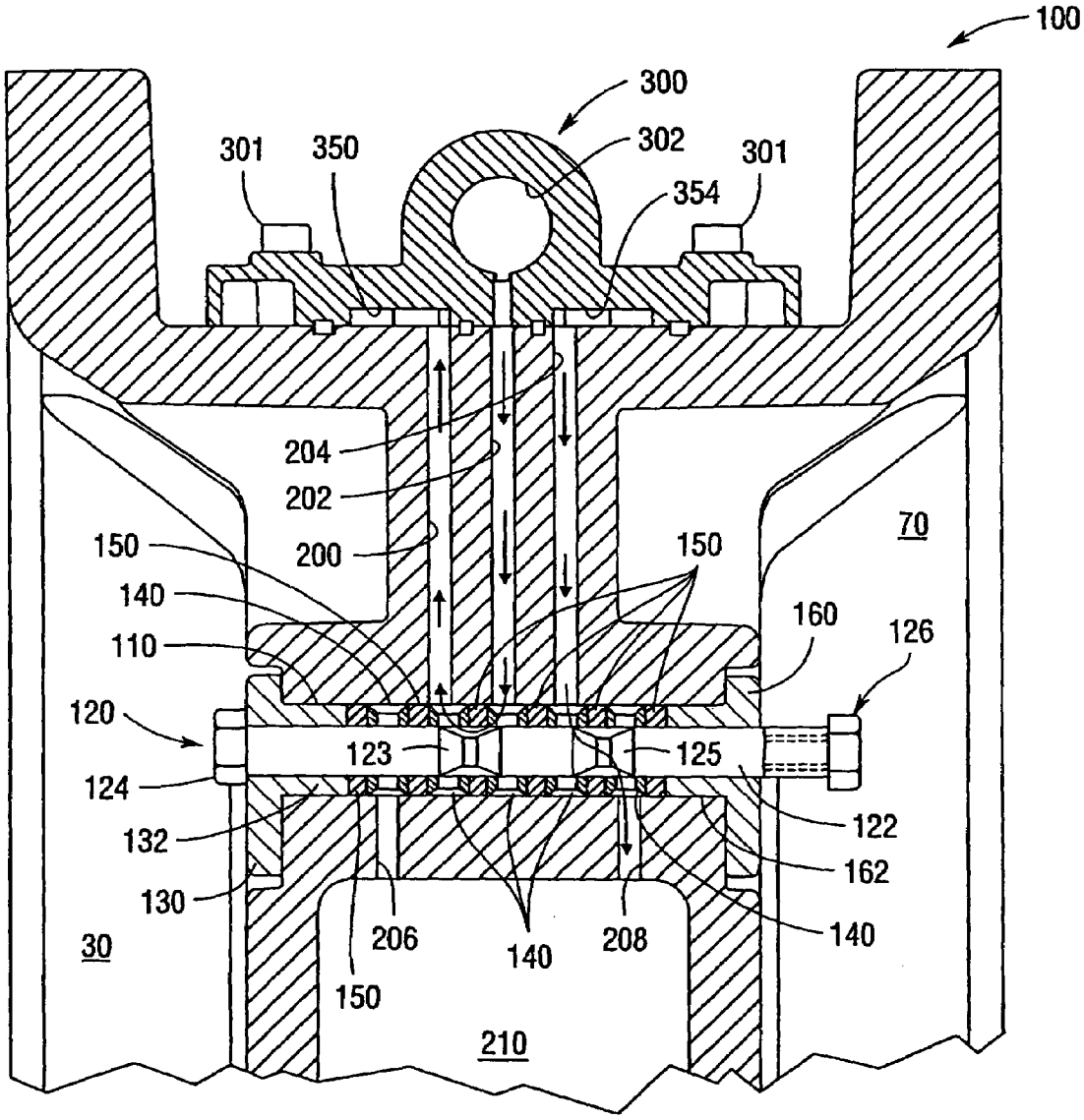
FIG. 9 is a partial cross-sectional view of the center housing section taken along line IX—IX in FIG. 8.
Figure 10:
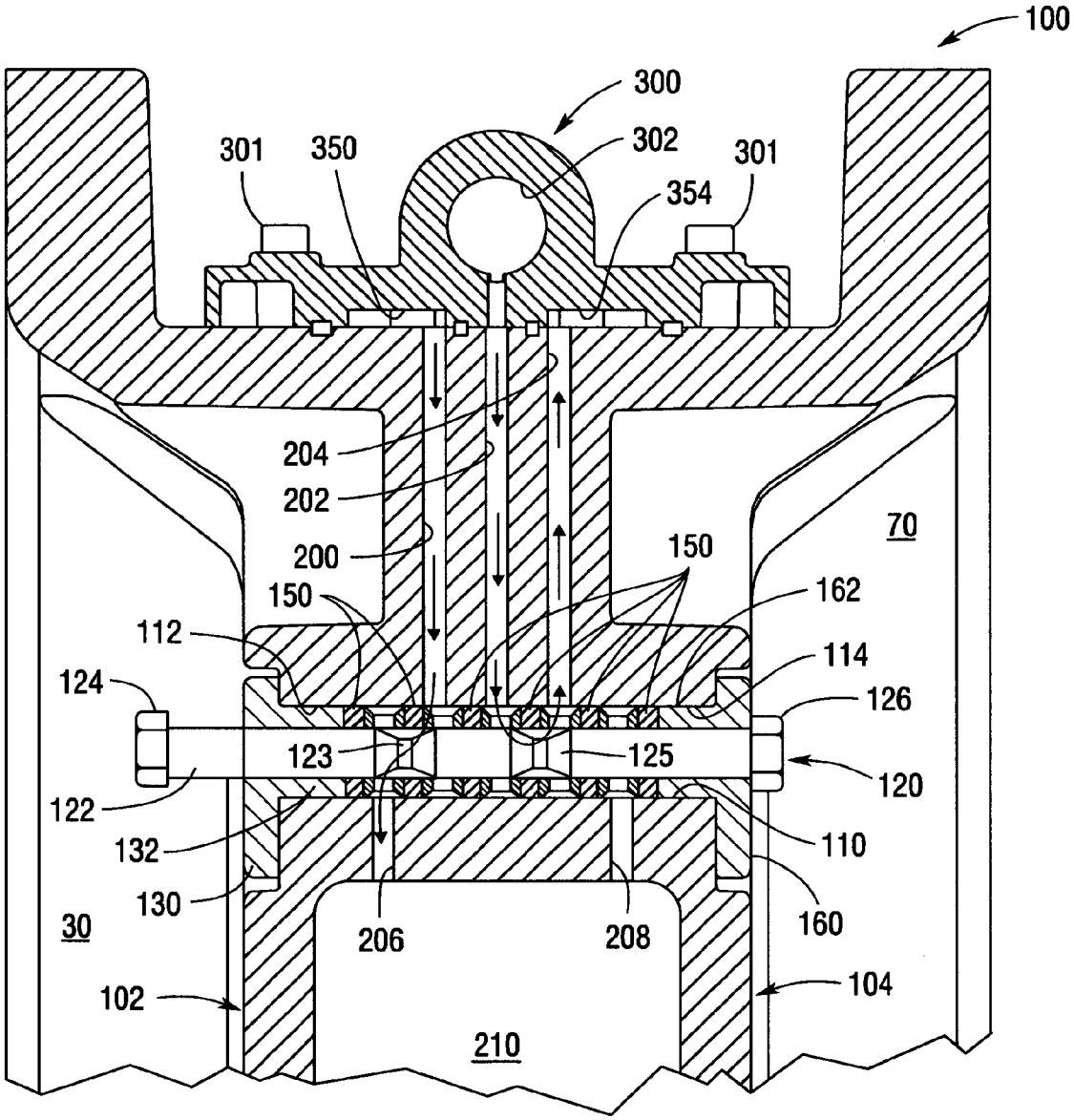
FIG. 10 is a partial cross-sectional view of the center housing section taken along line X—X in FIG. 8.

As can be seen in FIGS. 9 and 10, the center housing section 100 may have a pilot shaft passage 110 therethrough to accommodate a pilot shaft 120. Pilot shaft 120 may comprise a rod 122 that has a first end nut 124 formed on one end of the rod 122 or otherwise attached thereto and a second end nut 126 attached to the other end of the rod 122. Pilot shaft 120 is slidably retained in the pilot shaft passage 107 by a first pilot shaft retainer 130 and a second pilot shaft retainer 160. In one embodiment, the first pilot shaft retainer 130 may be configured as shown in FIGS. 9–11 and include a first hollow extension 132 sized to be received in a first end 112 of the pilot shaft passage 110. First shaft retainer 130 may be attached to the first end 102 of the center housing section 100 with suitable fasteners such as screws 134. Similarly, the second pilot shaft retainer 160 may be configured as shown in FIGS. 9–11 and include a second hollow extension 162 sized to be received in a second end 114 of the pilot shaft passage 110. Second shaft retainer 160 may be attached to the second end 104 of the center housing section 100 with suitable fasteners such as screws 164. The pilot shaft 120 is slidably supported in the pilot shaft passage 110 by a plurality of pilot shaft rings 140 and a plurality of O-rings 150 which vertically space the pilot shaft rings 140 apart.

In this embodiment, the first and second diaphragms 24, 64 may be interconnected by a diaphragm shaft 40 that has a first threaded end 42 and a second threaded end 44. In one embodiment, the first threaded end 42 is attached to the first diaphragm 24 by a first nut 43 and the second threaded end 44 is attached to the second diaphragm by a second nut 46. However, other methods of fastening the diaphragm shaft 40 to the first and second diaphragms 24, 64 could be employed. Also in this embodiment, a portion of the first diaphragm 24 is trapped between a pair of first washers 45 journaled on the diaphragm shaft 40 (FIGS. 6 and 7) and the second diaphragm 64 is trapped between a pair of second washers 47 journaled on the diaphragm shaft 40. See FIG. 6. In this embodiment, one of the first washers 45 serves as a first actuator member and one of the second washers 47 functions as a second actuator member as discussed in further detail below. The diaphragm shaft 40 extends through a shaft passage 107 in the center housing section 100. See FIG. 6. A fluidtight sliding seal may be established between the diaphragm shaft 40 and center housing section 100 by an 0-ring 109 on both sides of the center housing which are held in place by corresponding shaft retainers 130 and 160. Accordingly, as one of the chambers 30, 70 expands due to outward movement of its respective diaphragm, the other of the chambers 30, 70 contracts due to inward movement of its respective diaphragm 24, 64.

Figure 12:
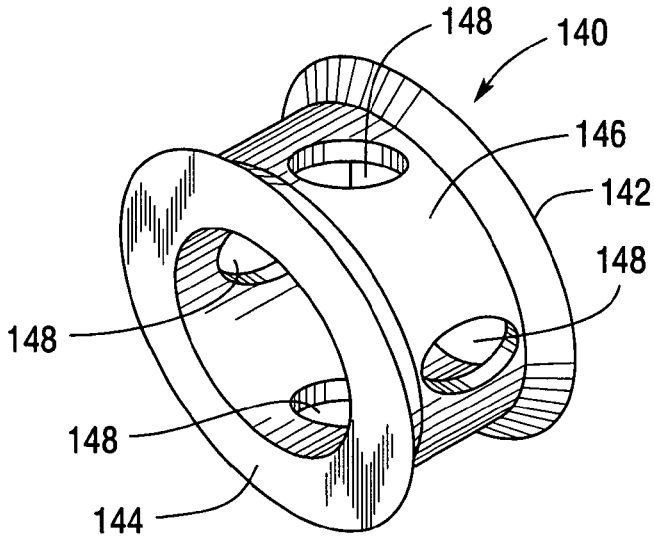
FIG. 12 is a perspective view of a ring of one embodiment of the present invention.
Figure 13:
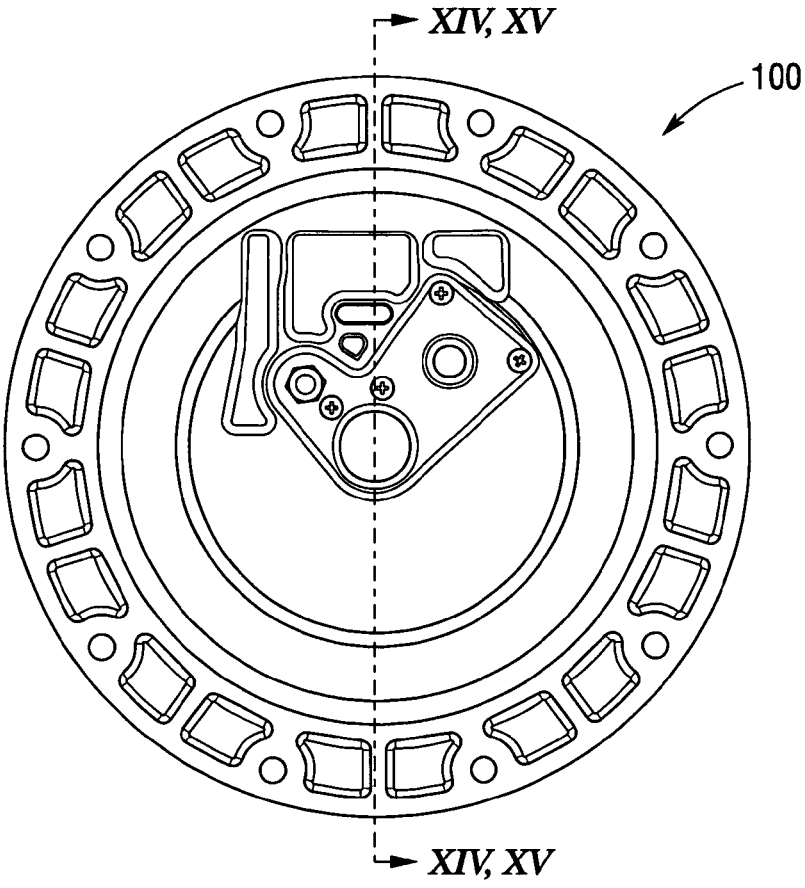
FIG. 13 is a side elevational view of a center housing section of one embodiment of the present invention.

As seen in FIG. 12, each of the pilot shaft rings 140 includes an upper flange 142, a lower flange 144, a reduced diameter portion 146, and a plurality of holes 148 extending through the reduced diameter portion 146. The pilot shaft rings 140 allow fluid communication to be made from the interior of the pilot shaft passage 110 to the fluid passages 200, 202, 204 and exhaust passages 206, 208, and need only be machined within relatively large tolerances since compression of the O-rings 150 provides a seal against the upper and lower flanges 142, 144 of the ring 140, the inner wall of the pilot shaft passage 110 and the pilot shaft 120. If the rings 140 were not used, a hollow cylinder having holes in a side wall thereof would need to be precision machined so that its outer diameter would fit tightly within the pilot shaft passage 110 and its inner diameter would fit tightly around the pilot shaft 120 while still allowing the pilot shaft 120 to slide therein.

As shown in FIGS. 9, 10, 14, 15, 23 and 24, the center housing section 100 may have a control housing or spool valve housing 300 attached thereto which includes an inlet 302 and a spool valve chamber 304. Inlet 302 may be threaded or otherwise attachable to a source of pressurized fluid (graphically designated as 303 in FIG. 1). As used herein, the term "pressurized fluid" may mean pressurized air or other pressurized fluid material (i.e., gas, liquids, etc.). The spool valve housing 300 may be fabricated from a polymeric material such as, for example, Kynar®) and be removably fastened to the center housing section 100 by suitable fasteners such as capscrews 301 or the like. However, the spool valve housing 300 may be fabricated from other suitable materials such as steel, aluminum, titanium, etc. In one embodiment, a spool valve 310 is slidably received within the spool valve chamber 304, and includes a first end 312 and a second end 314 which are separated by a central shaft portion 316 that has a diameter which is smaller than the diameters of the first and second ends 312, 314.

As can be seen in FIGS. 14, 15, 23 and 24, the first end 312 of the spool valve may be fitted with a first O-ring 313 or other suitable seal member for establishing a sliding seal between the first end 312 and the inner wall of the spool valve chamber 304. Likewise, the second end 314 of the spool valve 310 may be fitted with a second O-ring 315 or similar seal member for establishing a sliding seal between the second end 314 and the inner wall of the spool valve chamber 304. In one embodiment, a first end 305 of the spool valve chamber 304 is sealed with an end cap 320 that is received in the first end 305. See FIG. 11. To establish a substantially fluidtight seal between the first end cap 320 and the inner wall of the spool valve chamber 304, the first end cap 320 may be fitted with an O-ring 322 or other suitable seal member. In one embodiment, the first end cap 320 may be formed with ears 324 that define an annular groove 325 in the end cap 320. Once the first end cap 320 is positioned in the end 305 of the spool valve chamber 304, it may be removably retained in position by inserting a U-shaped retainer 328 through holes 307 in the spool valve housing 300 such that the ends of the retainer 328 extend into the annular groove 325 provided in the end cap 320. To prevent the retainer 328 from inadvertently backing out of the holes 307 in the spool valve housing 300, a retainer cap 330 may be snapped onto or otherwise removably attached to the spool valve housing 300 as shown in FIG. 11.

Figures 16, 17:
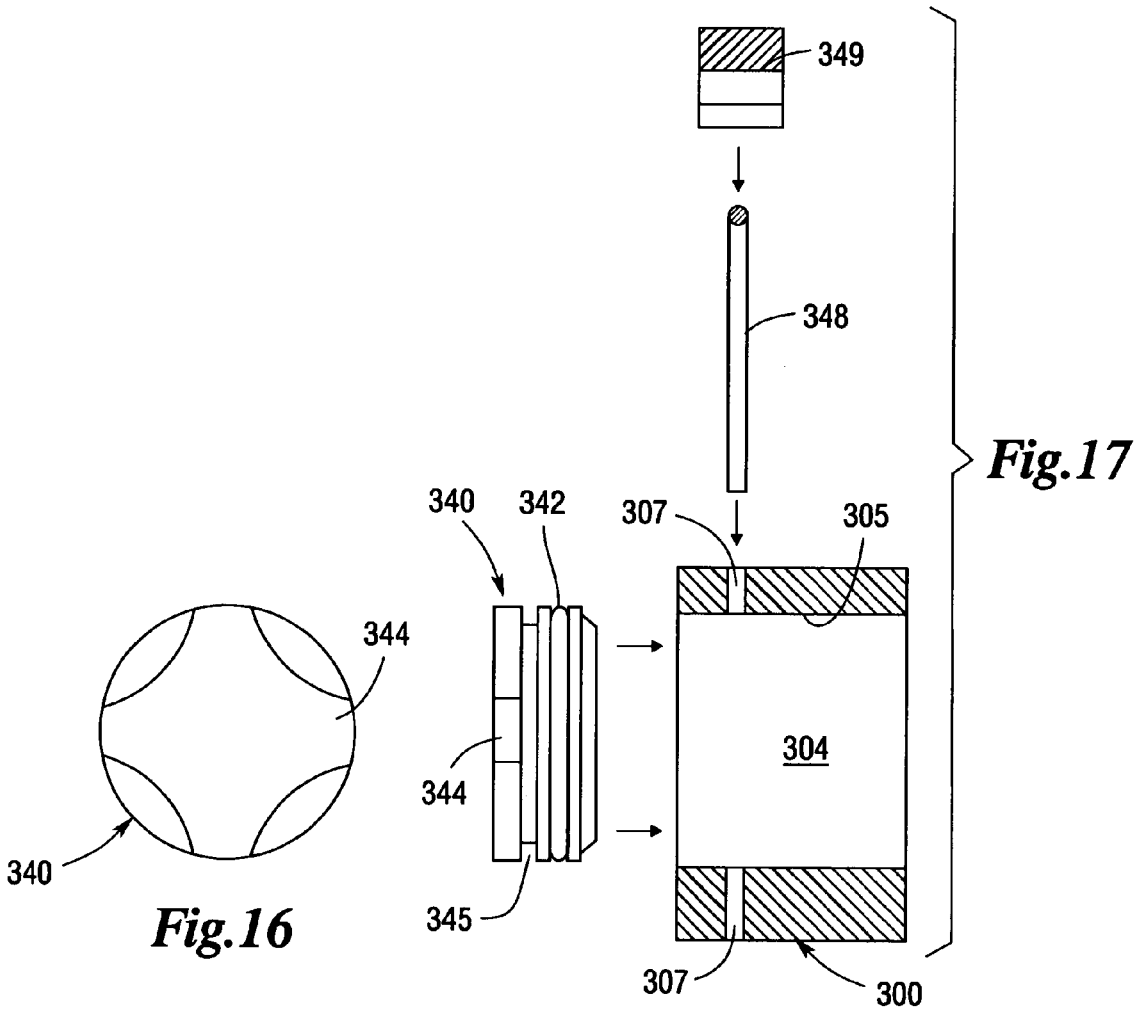
FIG. 16 is an end view of a second end cap of one embodiment of the present invention.
FIG. 17 is an exploded partial assembly view of the second end cap and a valve spool housing of one embodiment of the present invention.

Similarly, a second end 306 of the spool valve chamber 304 may be sealed with an end cap 340 that is received in the second end 306. To establish a substantially fluidtight seal between the second end cap 340 and the inner wall of the spool valve chamber 304, the second end cap 340 may be fitted with an O-ring 342 or other suitable seal member. See FIGS. 16 and 17. In one embodiment, the second end cap 340 may be formed with ears 344 that define an annular groove 345 in the end cap 340. Once the second end cap 340 is positioned in the end 306 of the spool valve chamber 304, it may be removably retained in position by inserting a U-shaped retainer 348 through holes 347 in the spool valve housing 300 such that the ends of the retainer 348 extend into the annular groove 345 provided in the end cap 340. To prevent the retainer 348 from inadvertently backing out of the holes 347 in the spool valve housing, a retainer cap 349 may be snapped onto or otherwise removably attached to the spool valve housing 300.

Figure 18:
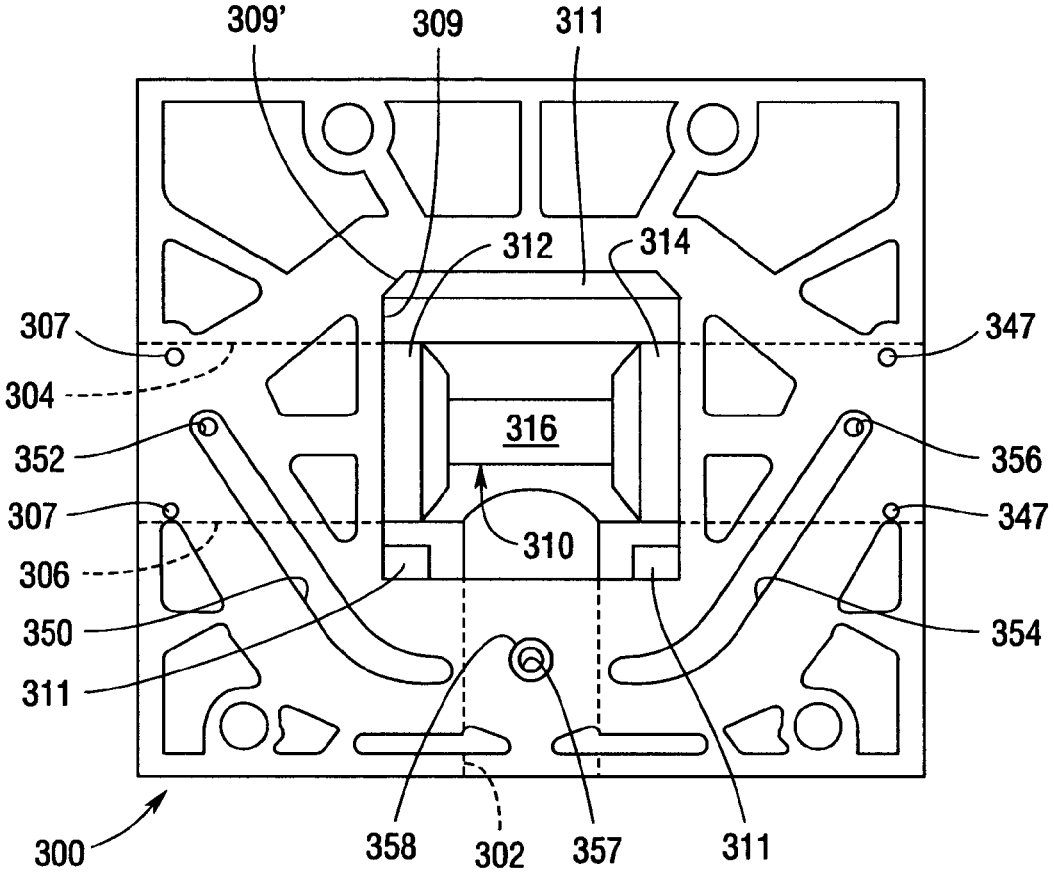
FIG. 18 is a bottom view of a valve spool housing of one embodiment of the present invention.

FIG. 18 illustrates the bottom of one embodiment of the spool valve housing 300 of the present invention. As can be seen in that Figure, a first flow cavity 350 is formed in the bottom of the spool valve housing 300 and communicates with flow port 352 that extends into the spool valve chamber 304 adjacent the first end 305 thereof. Similarly, a second flow cavity 354 is formed in the bottom of spool valve housing 300 and communicates with flow port 356 that extends into the spool valve chamber 304 adjacent the second end 306 thereof. In addition, a third cavity 358 is centrally located between the first and second flow cavities 350, 354 and communicates with a flow port 357 that extends into the inlet port 302.

Figure 19:
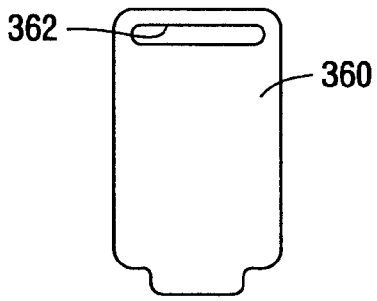
FIG. 19 is a bottom view of a diverter of one embodiment of the present invention.
Figure 20:
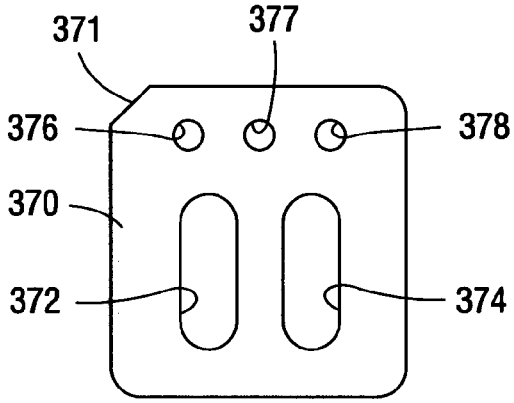
FIG. 20 is a bottom view of a diverter plate of one embodiment of the present invention.

In this embodiment of the present invention, a diverter block 360 may be employed in connection with a diverter plate 370. See FIGS. 19–21. In one embodiment, the diverter block 360 and diverter plate 370 are fabricated from ceramic material such that the diverter block 360 can slidably move on the diverter plate 370 while maintaining a fluidtight seal between those parts. It has been discovered that diverter plates and blocks fabricated from ceramic do not wear out as fast as diverter plates and block made from plastic material due to the hardness of the ceramic. In addition, ceramic does not heat up like plastics or metals resulting from friction created by the diverter block sliding on the diverter plate. Diverter plate 370 is sized to be received in a correspondingly shaped opening 309 through the bottom of the spool valve housing 300 and may be seated therein on standoffs 311 formed around the perimeter of the opening 309 such that when the diverter plate 370 is received on the standoffs 311, it is flush with the bottom of the spool valve housing 300. In one embodiment, the opening 309 has a notched comer 309' which corresponds to a an angled corner 371 to assist in the assembly process and ensure that the diverter plate 370 is properly oriented within opening 309. As can be seen in FIG. 20, the diverter plate 370 has two centrally disposed elongated flow passages 372, 374 therethrough. When the spool valve housing 300 is attached to the center housing portion 100, the flow passage 372 corresponds with a first expansion chamber flow passage 380 in the center housing section 100 that opens in to the first expansion chamber 30 and flow passage 374 corresponds with a second expansion chamber flow passage 382 in central housing section 100 that opens into the second expansion chamber 70.

As can be seen in FIG. 11, in this embodiment, a gasket or seal 390 may be employed to achieve a fluidtight seal between the spool valve housing 300 and the central housing portion 100. Diverter plate 370 may also have a series of three ports 376, 377, 378 therethrough. When the spool valve housing 300 is attached to the center housing section 100, the port 376 corresponds to an exhaust passage 400 in the center housing section 100, port 377 corresponds to an exhaust passage 402 in the center housing section 100 and port 378 corresponds to an exhaust port 404 in the center housing section 100. See FIGS. 23 and 24.

Figure 21:
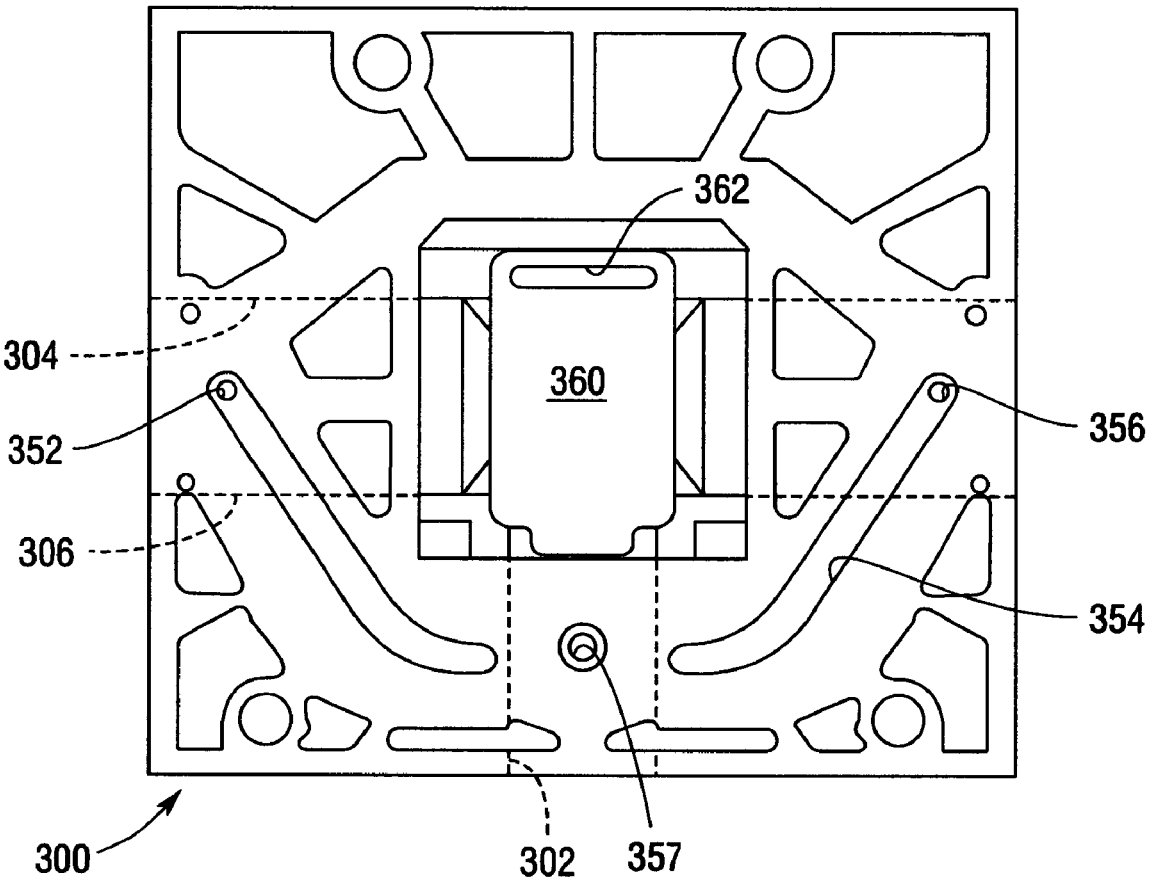
FIG. 21 is a bottom view of the valve spool housing of FIG. 18 with the diverter installed.
Figure 22:
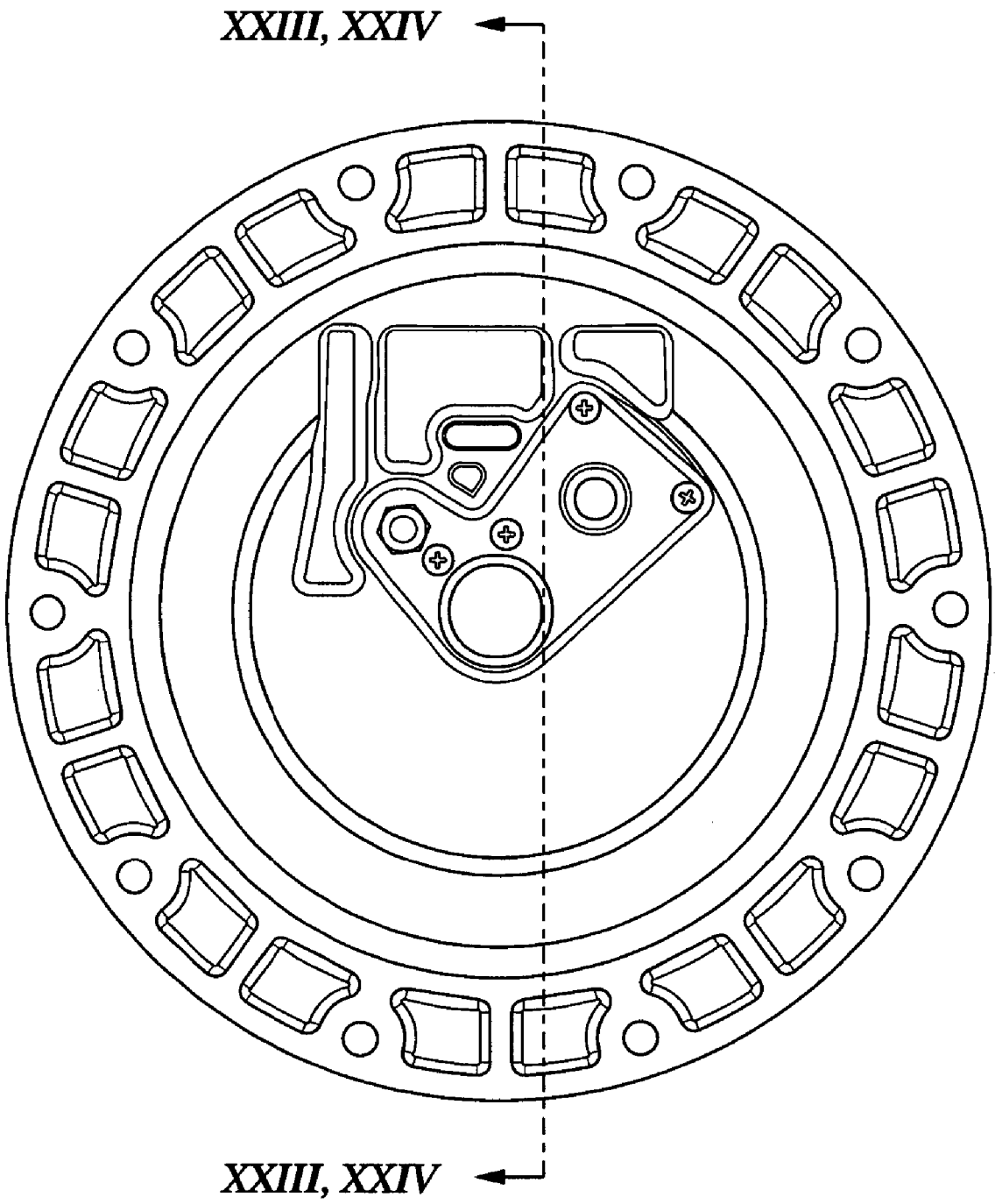
FIG. 22 is a side elevational view of a center housing section of one embodiment of the present invention.

As can be seen in FIG. 21, diverter block 360 may be sized to be received between first portion 312 and second portion 314 of spool valve 310. Thus, as spool valve 310 is slidably moved in the spool valve chamber 304 (as will be discussed in further detail below), the diverter block 360 also moves. In one embodiment, diverter block 360 has a groove 362 formed in the end thereof. As diverter block 360 is laterally moved on the diverter plate 370 by virtue of movement of the spool valve 310 within the spool valve chamber 304, groove 362 serves to form a flow passage either between ports 376 and 377 or between 377 and 378 to permit fluid to flow therebetween.

Figure 23:
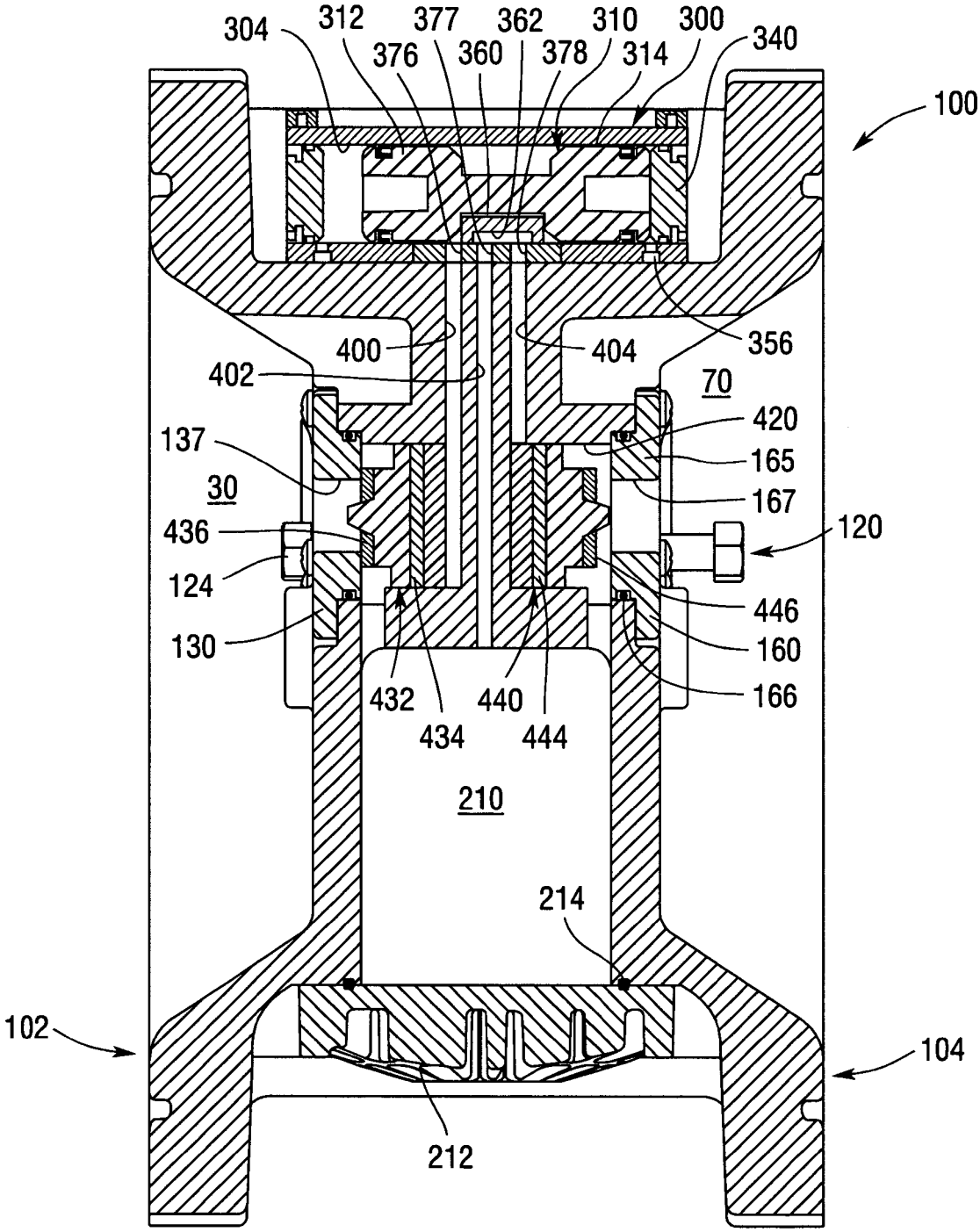
FIG. 23 is a cross-sectional view of the center housing portion of FIG. 22, taken along line XXIII—XXIII in FIG. 22.
Figure 24:
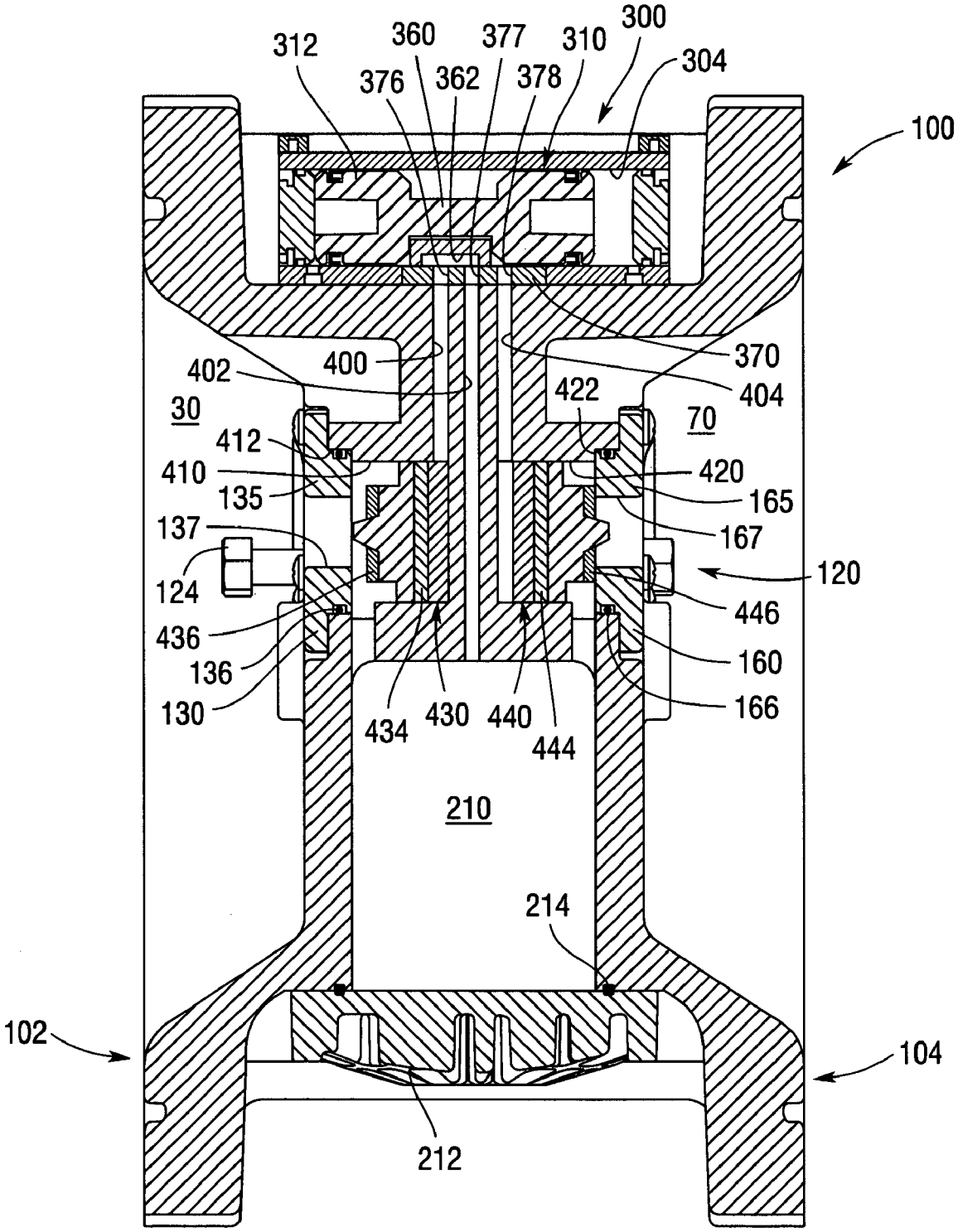
FIG. 24 is cross-sectional view of the center housing portion of FIG. 22, taken along line XXIV—XXIV in FIG. 22.

FIGS. 23 and 24 illustrate an embodiment of the present invention wherein separate exhaust valves 430 and 440 are employed. In particular, the first exhaust valve 430 may comprise a valve body 432 fabricated from, for example, acrylonitrile/butadiene/styrene (ABS) resin and be configured as shown. First exhaust valve 430 may be sized to be slidably received in a first exhaust valve cavity 410 provided in the center housing section 100 and be fitted with an O-ring 434 or other sealing arrangement to achieve a fluidtight seal between the valve 430 and the wall of the first exhaust valve cavity 410. In addition, in one embodiment, the first pilot shaft retainer 130 has a protruding flanged portion 135 that is sized to be received in a countersunk portion 412 of first exhaust valve cavity 410. To achieve a fluidtight seal between flanged portion 135 and the countersunk portion 412 of the first exhaust valve cavity 410, the flanged portion 135 may be fitted with an O-ring 136. Also in this embodiment, the first exhaust valve 430 is fitted with an end seal 436 such that when the exhaust valve 430 is forced under pressure into contact with the flanged portion 135 of the first pilot shaft retainer 130, a fluidtight seal is established therebetween.

Similarly, the second exhaust valve 440 may comprise a valve body 442 fabricated from, for example, acrylonitrile/butadiene/styrene (ABS) resin and be configured as shown. Second exhaust valve 440 may be sized to be slidably received in a second exhaust valve cavity 420 provided in the center housing section 100 and be fitted with an O-ring 444 to achieve a fluidtight seal between the valve 440 and the wall of the second exhaust valve cavity 420. In addition, in one embodiment, the second pilot shaft retainer 160 has a protruding flanged portion 165 that is sized to be received in a countersunk portion 422 of second exhaust valve cavity 420. To achieve a fluidtight seal between flanged portion 165 and the countersunk portion 422 of the second exhaust valve cavity 420, the flanged portion 165 may be fitted with an O-ring 166. Also in this embodiment, the second exhaust valve 440 is fitted with an end seal 446 such that when the second exhaust valve 440 is forced under pressure into contact with the flanged portion 165 of the second pilot shaft retainer 160, a fluid-tight seal is established therebetween.

The structure and operation of the above-described embodiment of the double diaphragm air driven pump 10 will now be explained. The spool valve 310, the pilot shaft 120, the diverter plate 370, the diverter block 360 and the various fluid passages 200, 202, 204, 206, 208, 380, 382 and exhaust valves 430 and 440 comprise a fluid control system which, as will be discussed below, acts to alternately expand the first and second expansion chambers 30, 70. Thus, as the first expansion chamber 30 expands and the first diaphragm 24 necessarily moves outwardly (to the left in FIG. 6), the second diaphragm 64 is pulled inwardly by the diaphragm shaft 40 and the second expansion chamber 70 contracts. As the first expansion chamber 30 expands, the fluid or semi-solid material in pumping chamber 26 is forced out through outlet 34 and check valve 35. Similarly, as the second expansion chamber 70 contracts, the adjacent pumping chamber 66 expands and pulls fluid or semisolid material into the pumping chamber 66 through inlet 72 and check valve 73. When the control system reverses the process and begins to expand the second chamber 70 and thus contracts the first chamber 30, the pumping chamber 66 adjacent the second chamber 70 discharges the material therein through the check valve 75 in outlet 74 and the pumping chamber 26 adjacent the first chamber 30 draws material in through the check valve 22 and inlet 32. In this manner, the pump 10 acts to pump a fluid or semisolid along two flow paths.

Figure 14:
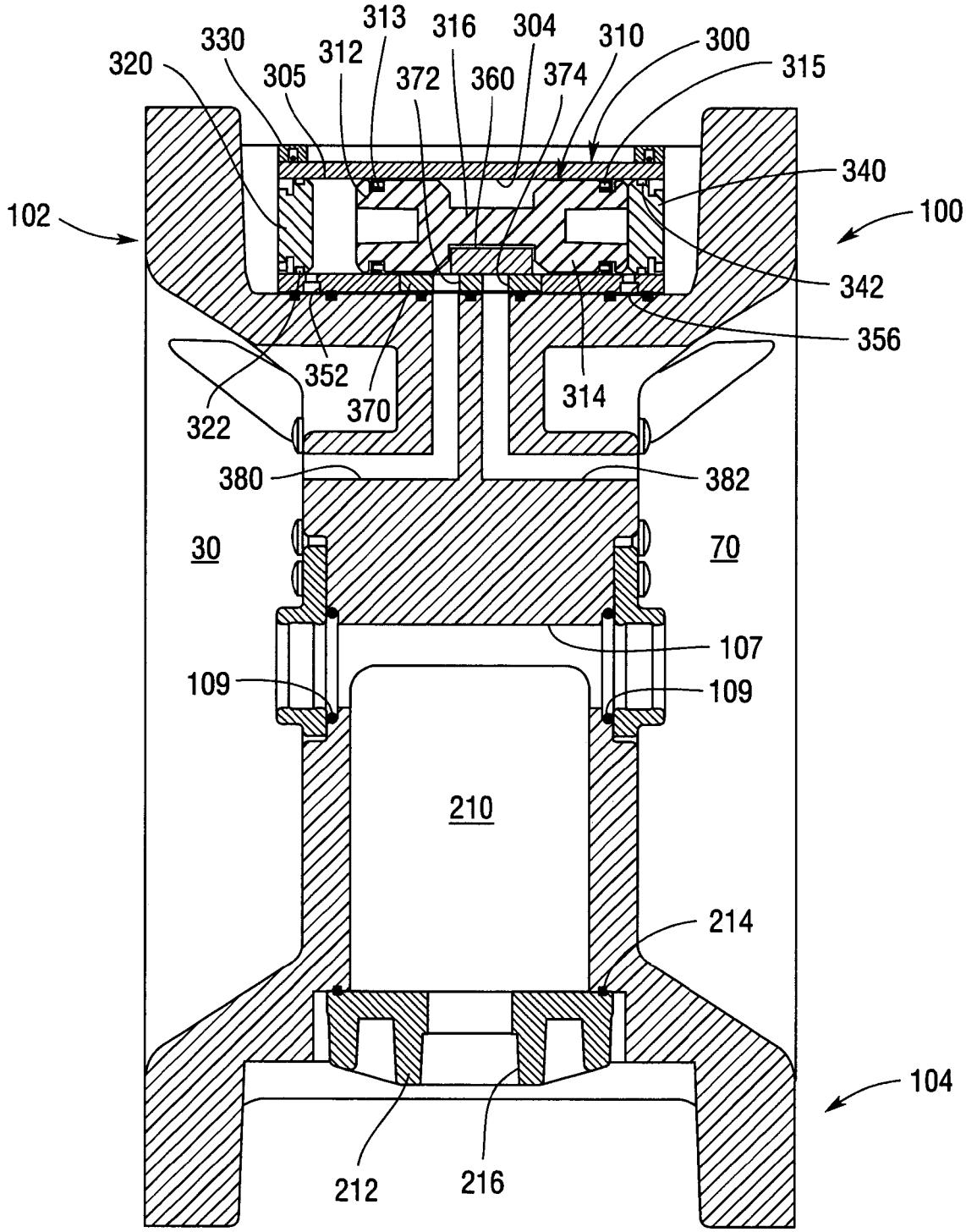
FIG. 14 is a cross-sectional view of the center housing section of FIG. 13 taken along line XIV—XIV in FIG. 13.
Figure 15:
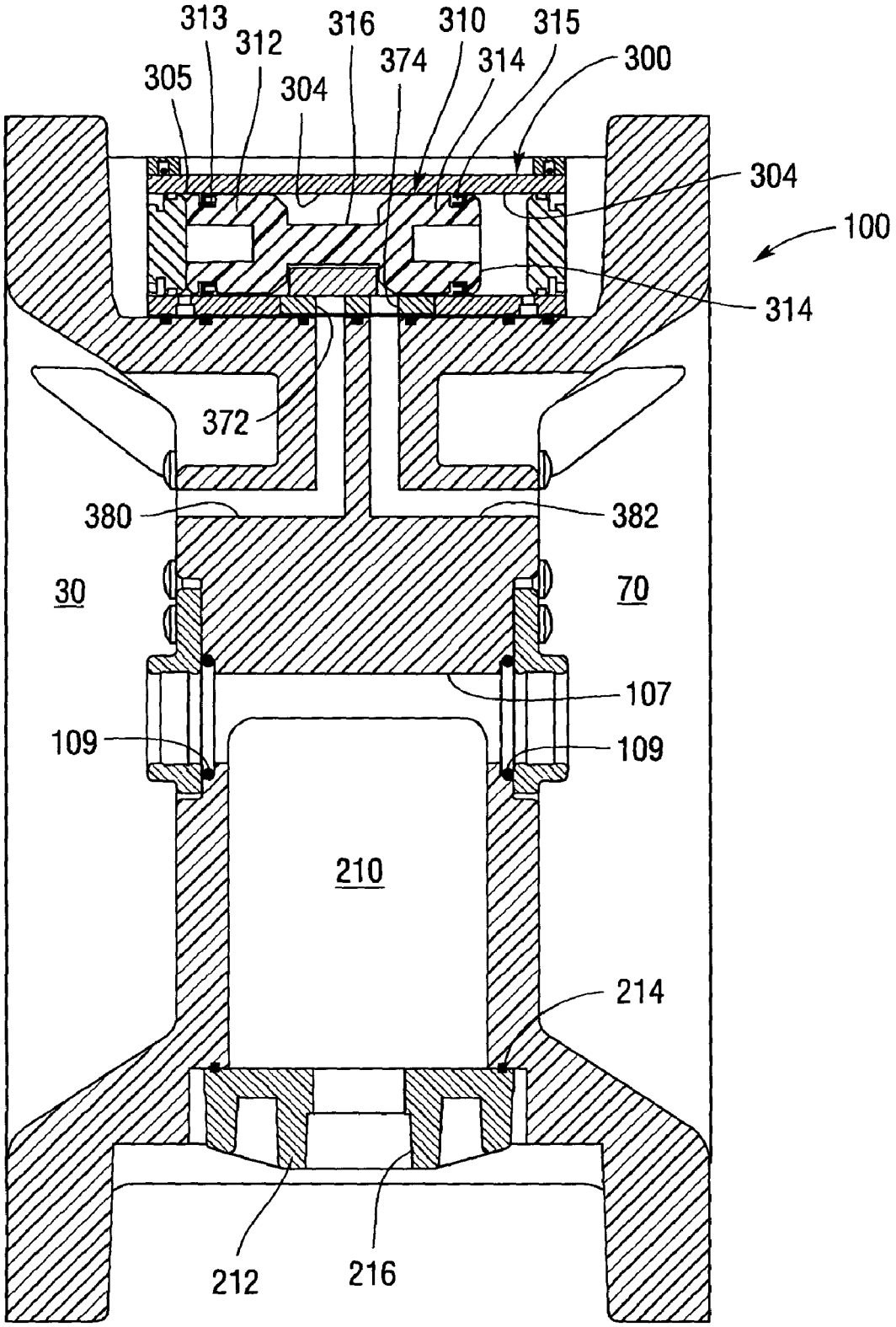
FIG. 15 is a cross-sectional view of the center housing section of FIG. 13 taken along line XV—XV in FIG. 13.

With reference to FIGS. 9, 10, 14, 15, 23 and 24, the operation of the control system will now be explained. The spool valve 310 may be movable between a first position, as seen in FIGS. 14 and 23, and a second position, as seen in FIGS. 15 and 24. In the first position of the spool valve 310, the diverter block 360 does not block the first expansion chamber passage 380, such that pressurized fluid (i.e., pressurized air) entering the spool valve housing 300 through inlet 302 flows through passage 380 and fills expansion chamber 30 causing it to expand. The groove 362 in the diverter block 360 forms a passage between ports 377 and 378 in the diverter plate 370 and thus between passages 402 and 404. Passage 404 extends through the center housing section 100 between port 377 in the diverter plate 370 and the central exhaust cavity 210 as shown in FIG. 23. Passage 400 extends between port 378 in the diverter plate 370 and the second exhaust valve cavity 320. As the second expansion chamber 70 starts to contract, the fluid (air) in the second expansion chamber 70 forces the end seal 446 of the second exhaust valve 440 out of sealing contact with the flanged portion 165 of the second pilot shaft retainer 160 through a hole 167 in the second pilot shaft retainer 160 and flanged portion 165. Air or fluid between the bottom of the second exhaust valve 440 and the bottom of the second exhaust valve cavity 420 is forced through passage 404 and passes into passage 402 by virtue of the groove 362 in the diverter block 360 and enters the central exhaust cavity 210 and ultimately may exit the pump 10 through port 216 in the end cap 212. See FIGS. 14 and 23.

The spool valve 310 will remain in the first position shown in FIGS. 14 and 23 as long as the pilot shaft 120 remains in the second position shown in FIG. 9. In the second position, the pilot shaft 120 connects the passage 202, which is open to the inlet 302 through port in the spool valve housing 300, to the passage 200 through the reduced diameter portion 123 of the pilot shaft 120, and connects the passage 204 to the exhaust passage 208 through the reduced diameter portion 125 of the pilot shaft 120. The flow passage 200 discharges the pressurized fluid from the inlet 302 into the flow cavity 350 in the bottom of the spool valve housing which discharges the fluid through the port 352 into the first end of the spool valve chamber 304 and thus cause the spool valve 310 to move to the first position depicted in FIG. 9. The pressurized fluid which is between the second end 314 of the spool valve 310 and the second end cap 340 is then free to exit the spool valve chamber 304 through the port 356 in the spool valve housing 300. The exiting fluid passes into the flow cavity 354 which transports it to passage 204. The exiting fluid passes from passage 204 and around the reduced diameter portion 125 of the pilot shaft 120 and into exhaust passage 208. The fluid can then exit the exhaust cavity 210 through port 216 in end cap 212.

As shown in FIG. 6, as the first diaphragm 24 moves outwardly the second diaphragm 64 moves inwardly, until the washer 47 on the diaphragm shaft 40 contacts the second end 126 of the pilot shaft 120 and moves the pilot shaft 120 from the second position thereof to a first position thereof. The second position of the pilot shaft 120 is shown in FIG. 10. In the second position, the passage 202 which is open to the inlet 302 is connected to the passage 204 through the reduced diameter portion 125 of the pilot shaft 120, and the passage 200 is connected to the exhaust passage 206 through the reduced diameter portion 123. Thus, pressurized fluid entering the spool valve housing 300 through inlet 302 passes through passage 202 and into passage 204. Passage 204 discharges the pressurized fluid into the flow cavity 354 which discharges it through port 356 into the second end 306 of the spool valve chamber 304. Pressurized fluid between the first end 312 of the spool valve 310 and the first end cap 320 can exit the first end 305 of the spool valve chamber 304 through port 352 in the spool valve housing 300. Pressurized fluid passing through the port 352 enters flow cavity 350 which discharges it into flow passage 200. The pressurized fluid exits passage 200 around the reduced diameter portion 123 of the pilot shaft 120 and into exhaust passage 206 wherein it is exhausted into exhaust cavity 210 and ultimately out through port 216 in end cap 212. Thus, such action biases the spool valve 310 to the position shown in FIGS. 15 and 24.

The spool valve 310 will remain in the first position shown in FIGS. 14 and 23 as long as the pilot shaft 120 remains in the first position shown in FIG. 9. In the first position, the pilot shaft 120 connects a first flow control passage 202, which is open to the inlet 302 through port 357 in the spool valve housing 300, to a second flow control passage 200 through the reduced diameter portion 123 of the pilot shaft 120, and connects a third flow control passage 204 to the exhaust passage 208 through the reduced diameter portion 125 of the pilot shaft 120. The second flow control passage 200 discharges the pressurized fluid from the inlet 302 into the flow cavity 350 in the bottom of the spool valve housing 300 which discharges the fluid through the port 352 into the first end of the spool valve chamber 304 and thus cause the spool valve 310 to move to the first position depicted in FIG. 9. The pressurized fluid which is between the second end 314 of the spool valve 310 and the second end cap 340 is then free to exit the spool valve chamber 304 through the port 356 in the spool valve housing 300. The exiting fluid passes into the flow cavity 354 which transports it to the third flow control passage 204. The exiting fluid passes from the third flow control passage 204 and around the reduced diameter portion 125 of the pilot shaft 120 and into exhaust passage 208. The fluid can then exit the exhaust cavity 210 through port 216 in end cap 212.

As shown in FIG. 6, as the first diaphragm 24 moves outwardly the second diaphragm 64 moves inwardly, until the washer 47 (the second actuator member) on the diaphragm shaft 40 contacts the second end 126 of the pilot shaft 120 and moves the pilot shaft 120 from the second position thereof to a first position thereof. The second position of the pilot shaft 120 is shown in FIG. 10. In the second position, the first flow control passage 202 which is open to the inlet 302 is connected to the third flow control passage 204 through the reduced diameter portion 125 of the pilot shaft 120, and the second flow control passage 200 is connected to the exhaust passage 206 through the reduced diameter portion 123. Thus, pressurized fluid entering the spool valve housing 300 through inlet 302 passes through the first flow control passage 202 and into the third flow control passage 204. The third flow control passage 204 discharges the pressurized fluid into the flow cavity 354 which discharges it through port 356 into the second end 306 of the spool valve chamber 304. Pressurized fluid between the first end 312 of the spool valve 310 and the first end cap 320 can exit the first end 305 of the spool valve chamber 304 through port 352 in the spool valve housing 300. Pressurized fluid passing through the port 352 enters flow cavity 350 which discharges it into the second flow control passage 200. The pressurized fluid exits the second flow control passage 200 around the reduced diameter portion 123 of the pilot shaft 120 and into exhaust passage 206 wherein it is exhausted into exhaust cavity 210 and ultimately out through port 216 in end cap 212. Thus, such action biases the spool valve 310 to the position shown in FIGS. 15 and 24.

Also in this embodiment, the central housing section 100 may have a generally cylindrical shape and have a plurality of ribs 500 formed around its outer perimeter. See FIG. 11. The ribs 500 serve to strengthen the housing 12 against the forces generated during the reciprocation of the diaphragms during operation. Also, by providing a relatively large exhaust cavity 210 in the housing 12, the air from the ports discharging into the exhaust cavity 210 can discharge quickly into the cavity and expand without freezing.

The first expansion chamber 30 is in fluid communication with the exhaust port 216 and thus is able to contract because pressurized air which was compressed into the first chamber 30 can exhaust to the atmosphere through the port 216. Expansion of the second chamber 70 and contraction of the first chamber 30 continues until the first washer 45 (the first actuator member) on the diaphragm shaft 40 contacts the first end 124 of the pilot shaft 120 and moves it to the position shown in FIGS. 9 and 23. At this point, one complete cycle of the pump 10 has been completed and the cycle starts anew.

However, the invention which is intended to be protected is not to be construed as limited to the particular embodiment disclosed. The embodiment is therefore to be regarded as illustrative rather than restrictive. Variations and changes may be made by others without departing from the spirit of the present invention. Accordingly, it is expressly intended that all such equivalents, variations and changes which fall within the spirit and scope of the present invention as defined in the claims be embraced thereby.

What is claimed is:

1. A fluid driven pump comprising:

a housing assembly;

a first diaphragm supported in said housing assembly and defining a first pumping chamber and a first fluidtight expansion chamber within said housing assembly;

a second diaphragm supported in said housing assembly opposite said first diaphragm and coupled thereto, said second diaphragm defining a second pumping chamber and a second fluidtight expansion chamber within said housing assembly;

a first exhaust valve movably supported in a first exhaust valve cavity in fluid communication with said first expansion chamber and an exhaust port in said housing assembly;

a second exhaust valve movably supported in a second exhaust valve cavity in fluid communication with said second expansion chamber and said exhaust port;

a flow control system supported by said housing assembly and couplable to a source of pressurized fluid for controlling flow of pressurized fluid into and out of said first and second expansion chambers such that pressurized fluid entering said first expansion chamber flows through a first expansion chamber flow passage in said housing assembly independent from a first exhaust passage connecting said first exhaust valve cavity to said first expansion chamber and such that pressurized fluid entering said second expansion chamber flows through a second expansion chamber flow passage in said housing assembly independent from a second exhaust passage connecting said second exhaust valve cavity to said second expansion chamber.

2. The fluid driven pump of claim 1 wherein said flow control system comprises:

a control housing supported by said housing assembly and couplable to the source of pressurized fluid;

a diverter block supported in said control housing and movable between first and second positions therein wherein said first expansion chamber flow passage extends between said control housing and said first expansion chamber, such that when said diverter block is in said first position, pressurized fluid entering said control housing is permitted to flow through said first expansion chamber flow passage into said first expansion chamber and wherein said second expansion chamber flow passage extends between said control valve housing and said second expansion chamber, such that when said diverter block is in said second position, pressurized fluid entering control housing is permitted to flow through said second expansion chamber flow passage into said second expansion chamber;

a first exhaust valve flow passage in said housing assembly extending between said control housing and said first exhaust valve cavity such that when said diverter block is in said first position, pressurized fluid entering said control housing biases said first exhaust valve into a closed position wherein said first expansion chamber is permitted to be pressurized and when said diverter block is in said second position, said diverter block causes the first exhaust valve flow passage to communicate with said exhaust port in said housing assembly to enable said first exhaust valve to move to a first exhaust position wherein said first expansion chamber is caused to communicate with said exhaust port;

a second exhaust valve flow passage in said housing assembly extending between said control housing and said second exhaust valve cavity such that when said diverter block is in said second position, pressurized fluid entering said control housing biases said second exhaust valve to a closed position wherein said second expansion chamber is permitted to be pressurized and when said diverter block is in said first position, said diverter block causes said second exhaust valve flow passage to communicate with said exhaust port in said housing assembly to enable said second exhaust valve to move to a second exhaust position wherein said second expansion chamber is caused to communicate with said exhaust port; and a pilot shaft supported in said housing in fluid communication with said control housing such that expansion and contraction of said first and second expansion chambers causes said pilot shaft to control flow of pressurized fluid into and out of said control housing to control movement of said diverter block therein.

3. The fluid driven pump of claim 2 further comprising:

a spool valve chamber in said control housing, said spool valve chamber couplable with the source of pressurized fluid; and a spool valve movably supported in said spool valve chamber and movable between first and second positions therein in response to introduction of pressurized fluid into said spool valve chamber and exhaust of pressurized fluid from said spool valve chamber controlled by movement of said pilot shaft.

4. The fluid driven pump of claim 3 further comprising a diverter plate in said control housing, said diverter plate having ports therethrough corresponding to said first and second expansion chamber flow passages and said first and second exhaust valve flow passages and wherein said diverter block is slidably supported on said diverter plate and movable thereon between said first and second positions in response to movement of said spool valve within said spool valve chamber.

5. The fluid driven pump of claim 4 further comprising a central exhaust passage in said housing assembly between said spool valve chamber and said exhaust port and wherein said diverter block has a groove therein to permit passage of pressurized fluid from said second exhaust valve flow passage to said central exhaust valve passage when said diverter block is in said first position and flow from said first exhaust valve flow passage to said central exhaust valve passage when said diverter block is in said second position.

6. The fluid driven pump of claim 4 wherein said diverter block and said diverter plate are fabricated from ceramic material.

7. The fluid driven pump of claim 5 further comprising an exhaust cavity in said housing assembly and wherein said central exhaust valve passage, said first and second exhaust valve cavities and said exhaust port communicate with said exhaust cavity.

8. The fluid driven pump of claim 1 wherein said housing assembly comprises:

a central housing section having a first end and a second end;

a first housing section coupled to said first end of said central housing section; and a second housing section coupled to said second end of said central housing section.

9. The fluid driven pump of claim 8 wherein said first diaphragm has a perimeter and wherein said second diaphragm has a perimeter and wherein the perimeter of the first diaphragm is retained between said first housing section and said central housing section and wherein said perimeter of said second diaphragm section is between said second housing section and said central housing section.

10. The fluid driven pump of claim 8 wherein said central housing section has a cylindrical shape and a plurality of fins are formed around a perimeter thereof.

11. The fluid driven pump of claim 8 wherein said first diaphragm defines a first pumping chamber within said first housing section and wherein said second diaphragm defines a second pumping chamber within said second housing section.

12. The fluid driven pump of claim 11 further comprising:

a first inlet in said first housing section connected to a source of material to be pumped;

a first inlet check valve in said first inlet;

a first outlet in said first housing section; and a first outlet check valve in said first outlet.

13. The fluid driven pump of claim 12 further comprising:

a second inlet in said second housing section connected to the source of material to be pumped;

a second inlet check valve in said second inlet;

a second outlet in said second housing section; and a second outlet check valve in said second outlet.

14. The fluid driven pump of claim 13 wherein said first and second inlets are fluidically coupled together and wherein said first and second outlets are fluidically coupled together.

15. The fluid driven pump of claim 3 wherein said pilot shaft comprises:

an elongated rod slidably supported in said housing assembly and having a first end corresponding to said first diaphragm and a second end corresponding to said second diaphragm, said rod having a first reduced diameter to selectively permit fluid to flow from a first flow control passage in said housing assembly communicating with said source of pressurized fluid to a second flow control passage in said housing assembly communicating with a first port in said spool valve chamber adjacent a first end of said spool valve when said pilot shaft is in a first position and permit fluid to flow from said second flow control passage to an exhaust cavity within said housing assembly when said pilot shaft is in a second position, said rod further having a second reduced diameter to selectively permit fluid to flow from said first flow control passage into a third flow control passage in said housing assembly communicating with a second port in said spool valve chamber adjacent to a second end of said spool valve when said pilot shaft is in said second position and permit fluid to flow from said third flow control passage to said exhaust cavity when said pilot shaft is in said first position.

16. The fluid driven pump of claim 15 wherein said pilot shaft is slidably supported within a plurality of pilot shaft rings received within a pilot shaft passage in said housing assembly, said pilot shaft rings being separated from each other by corresponding O-rings received within said pilot shaft passage.

17. The fluid driven pump of claim 15 wherein said first diaphragm is connected to said second diaphragm by a diaphragm shaft slidably supported within said housing assembly, said diaphragm shaft having a first end and a first actuator member associated therewith such that when said first diaphragm is moved to a fully contracted position, said first actuator member biases said first end of said elongated rod to move said elongated rod to said first position and said diaphragm shaft having a second end and a second actuator member associated therewith such that when said second diaphragm is moved to a fully contracted position, said second actuator member biases said second end of said elongated rod to move said elongated rod to said second position.

18. The fluid driven pump of claim 17 wherein said housing assembly comprises:

a central housing section having a first end and a second end;

a first housing section coupled to said first end of said central housing section; and a second housing section coupled to said second end of said central housing section and wherein said fluid driven pump further comprises:

a first pilot shaft retainer attached to said first end of said central housing section; and a second pilot shaft retainer attached to said second end of said central housing section.

19. The fluid driven pump of claim 18 wherein said first exhaust passage extends through said first pilot shaft retainer to permit fluid to exit from said first expansion chamber therethrough into said first exhaust valve cavity when said first exhaust valve is in an exhaust position within said first exhaust valve cavity.

20. The fluid driven pump of claim 19 wherein said first pilot shaft retainer further comprises:

a first flanged portion sized to be received in a countersunk portion of said first exhaust valve cavity, said first exhaust passage extending through said first flanged portion; and a first seal between said first flanged portion and said first exhaust valve cavity to achieve a fluidtight seal therebetween.

21. The fluid driven pump of claim 19 wherein said first exhaust valve comprises:

a first body portion;

a first valve seal on said body portion for establishing a fluidtight sliding seal between said first body portion and said first exhaust valve cavity; and a first end seal for establishing a fluidtight seal with said first pilot shaft retainer.

22. The fluid driven pump of claim 19 wherein said second exhaust passage extends through said second pilot shaft retainer to permit fluid to exit from said second expansion chamber therethrough into said second exhaust valve cavity when said second exhaust valve is in an exhaust position within said second exhaust valve cavity.

23. The fluid driven pump of claim 22 wherein said second pilot shaft retainer further comprises:

a second flanged portion sized to be received in a countersunk portion of said second exhaust valve cavity, said second exhaust passage extending through said second flanged portion; and a second valve seal between said second flanged portion and said second exhaust valve cavity to achieve a fluidtight seal therebetween.

24. The fluid driven pump of claim 23 wherein said second exhaust valve comprises:

a second body portion;

a second seal on said body second portion for establishing a fluidtight sliding seal between said second body portion and said second exhaust valve cavity; and an end seal for establishing a fluidtight seal with said second pilot shaft retainer.

25. A fluid driven pump comprising:

a housing assembly;

a first diaphragm supported in said housing assembly and defining a first pumping chamber and a first fluidtight expansion chamber within said housing assembly;

a second diaphragm supported in said housing assembly opposite said first diaphragm and coupled thereto, said second diaphragm defining a second pumping chamber and a second fluidtight expansion chamber within said housing assembly;

a control housing attachable to a source of pressurized fluid, said control housing supporting a diverter block therein, said diverter block movable between first and second positions;

a first exhaust valve movably supported in a first exhaust valve flow cavity in fluid communication with said first expansion chamber and an exhaust port in said housing assembly;

a second exhaust valve movably supported in a second exhaust valve cavity in fluid communication with said second expansion chamber and said exhaust port;

a first expansion chamber flow passage in said housing assembly and extending between said control housing and said first expansion chamber such that when said diverter block is in said first position, pressurized fluid entering said control housing is permitted to flow into said first expansion chamber;

a second expansion chamber flow passage in said housing assembly and extending between said control valve housing and said second expansion chamber such that when said diverter block is in said second position, pressurized fluid entering control housing is permitted to flow into said second expansion chamber;

a first exhaust valve flow passage in said housing assembly extending between said control housing and said first exhaust valve cavity such that when said diverter block is in said first position, pressurized fluid entering said control housing biases said first exhaust valve into a closed position wherein said first expansion chamber is permitted to be pressurized and when said diverter block is in said second position, said diverter block causes the first exhaust valve flow passage to communicate with an exhaust port in said housing assembly to enable said first exhaust valve to move to a first exhaust position wherein said first expansion chamber is in fluid communication with said exhaust port;

a second exhaust valve flow passage in said housing assembly extending between said control housing and said second exhaust valve cavity such that when said diverter block is in said second position, pressurized fluid entering said control housing biases said second exhaust valve to a closed position wherein said second expansion chamber is permitted to be pressurized and when said diverter block is in said first position, said diverter block causes said second exhaust valve flow passage to communicate with said exhaust port in said housing assembly to enable said second exhaust valve to move to a second exhaust position wherein said second expansion chamber is in fluid communication with said exhaust port; and a pilot shaft supported in said housing assembly in fluid communication with said control housing such that expansion and contraction of said first and second expansion chambers causes said pilot shaft to control flow of pressurized fluid into and out of said control housing to control movement of said diverter block therein.

* * * * *